US011096472B2

(12) United States Patent
Thompson

(10) Patent No.: US 11,096,472 B2
(45) Date of Patent: Aug. 24, 2021

(54) WEARABLE SPORTS EQUIPMENT CARRIER WITH ONE OR TWO SHOULDER STRAPS

(71) Applicant: Gary McClellan Thompson, El Segundo, CA (US)

(72) Inventor: Gary McClellan Thompson, El Segundo, CA (US)

(73) Assignee: Gary McClellan Thompson, El Segundo, CA (US)

( * ) Notice: Subject to any disclaimer, the term of this patent is extended or adjusted under 35 U.S.C. 154(b) by 98 days.

(21) Appl. No.: 16/174,240

(22) Filed: Oct. 29, 2018

(65) Prior Publication Data

US 2019/0059565 A1 Feb. 28, 2019

Related U.S. Application Data

(63) Continuation-in-part of application No. 15/488,044, filed on Apr. 14, 2017, now Pat. No. 10,314,383.

(Continued)

(51) Int. Cl.
*A45F 3/14* (2006.01)
*B63B 35/79* (2006.01)

(Continued)

(52) U.S. Cl.
CPC ..... *A45F 3/14* (2013.01); *A45F 3/15* (2013.01); *A45F 4/00* (2013.01); *B63B 35/7946* (2013.01);

(Continued)

(58) Field of Classification Search
CPC ..... A45F 3/14; A45F 3/02; A45F 2003/142; A45F 2005/1013; A45F 2005/1006; A45F 2005/006; A45F 5/00; Y10T 24/27; Y10T 24/2708; Y10T 24/4084; A63C 11/025; B65D 63/16; B65D 2312/02; B63B 35/746; B63B 35/79; B63B 35/7946; Y10S 224/917

(Continued)

(56) References Cited

U.S. PATENT DOCUMENTS 3,920,166 A * 11/1975 Hogensen, Jr. ..... A45F 5/00 224/586
4,672,910 A * 6/1987 Cook ..... B63B 17/02 114/343

(Continued)

*Primary Examiner* — Adam J Waggenspack

(57) ABSTRACT

A device for carrying a surfboard, similar sporting equipment or other objects. One embodiment is comprised of webbing material with one or two primary loop(s) having a loop buckle that slides along the primary loop and a strap element that in combination with the loop buckle creates a secondary adjustable secondary loop. The secondary adjustable secondary loop is used to hold a surfboard or other object securely in place via gravity acting on the object being carried and the primary loop, or adjustable primary loop supports the surfboard from one or both of the user's shoulder allowing hands free operation. When not utilized as a carrier the device can be worn, such as a belt. The user keeps the primary loop compressed together, wraps the carrier around his/her waist, through the loop buckle and then attaches it back onto itself. A personal flotation device can be attached to the strap element so that carrier and personal flotation device from a single unit.

14 Claims, 20 Drawing Sheets

Related U.S. Application Data

(60) Provisional application No. 62/668,319, filed on May 8, 2018, provisional application No. 62/578,513, filed on Oct. 29, 2017.

(51) Int. Cl.
*A45F 4/00* (2006.01)
*A45F 3/15* (2006.01)

(52) U.S. Cl.
CPC ... *A45F 2003/142* (2013.01); *A45F 2004/006* (2013.01)

(58) Field of Classification Search
USPC ..... 224/250, 257–259; D3/221
See application file for complete search history.

(56) References Cited

U.S. PATENT DOCUMENTS

D374,325 S * 10/1996 Merrill ..... D2/627
5,603,545 A * 2/1997 Benson ..... A45F 3/14
224/250

* cited by examiner

WEARABLE SPORTS EQUIPMENT CARRIER WITH ONE OR TWO SHOULDER STRAPS

CROSS-REFERENCE TO RELATED APPLICATIONS

This application is a continuation-in-part application of U.S. Pat. No. 9,801,454 B2, titled, "SPORTS EQUIPMENT CARRIER WHICH CAN BE WORN", Oct. 31, 2017, which claims the benefit of the priority date of U.S. Provisional Patent Application Ser. No. 62/140,382, titled, "SPORTS EQUIPMENT CARRIER WHICH CAN BE WORN", filed Mar. 30, 2015.

This application also claims the benefit of the priority date of U.S. Provisional Patent Application Ser. No. 62/369,001, titled, "Wearable sports equipment carrier with a personal flotation device", filed Jul. 29, 2016, of continuation-in-part application of U.S. patent application Ser. No. 15/488,044, titled Wearable Sports Equipment Carrier with a Personal Flotation Device", filed Apr. 14, 2017, of Provisional Patent Application Ser. No. 62/578,513, titled, "Wearable Sports Equipment Carrier Using D Ring & Ladder Lock With a Personal Flotation Device", filed Oct. 29, 2017, and of Provisional Patent Application Ser. No. 62/578,513, titled, "Wearable Sports Equipment Carrier With One or Two Shoulder Straps", filed May 8, 2018.

BACKGROUND OF THE INVENTION

1. Field of the Invention

This invention relates to a device for carrying sports equipment such as surfboards, stand up paddleboards (SUP), snowboards, snow skis, and the like, where the carrier device is self-adjusting to the size of the object being carried, and the device can be worn as a belt when not carrying the sports equipment.

2. Background

The following is a tabulation of some prior art that presently appears relevant:

| U.S. Patents | | | |
|---|---|---|---|
| Pat. No. | Kind Code | Issue Date | Patentee |
| 3,777,007 | 224-205 | August 1968 | Gaylor |
| 3,591,063 | 224-55 | July 1971 | Pearce |
| 4,483,380 | 206/315.1 | November 1984 | Beran |
| 4,804,025 | 224/604 | February 1989 | Bear |
| 5,094,344 | 206/315.1 | March 1992 | Savage |
| 4,724,989 | 224/609 | February 1988 | Silberberg |
| 5,823,551 | 280/47.131 | October 1998 | Conroy |

| Foreign Patent Documents | | | |
|---|---|---|---|
| Foreign Doc. Nr. | Kind Code | Publ. Date | Country |
| 2490597 | 224/917 | March 1982 | France |
| 3225842 | 206/523 | February 1984 | Germany |
| 8501194 | 224/917 | March 1985 | PCT Int'l Appl. |
| 20050236450 | 224/577.000 | 2005 Oct. 27 | PCT Int'l Appl. |
| 20080057805 | B63B 35/79 | June 2008 | PCT Int'l Appl. |

Carrying an article like a surfboard or stand up paddleboard (SUP) to and from the water has always been a problem since the inception of surfing. Surfboard designers design surfboards to facilitate their functionality while in the water. The width of a surfboard or SUP contributes to its floating capability and thus its performance. As the width of the board increases to improve performance, it becomes more difficult to carry. In some cases, people's arms are just not long enough to carry the surfboard or SUP. As result, many individuals have made attempts to solve this problem of carrying a surfboard to the water. These include the Sling for Surfboard (U.S. Pat. No. 3,777,007), Surfboard Carrier (U.S. Pat. No. 3,591,063), Foldable protective cover and carrier for sports equipment (U.S. Pat. No. 4,483,380), Carrying harness for surfboards and the like (U.S. Pat. No. 4,804,025), Surfboard carry case (U.S. Pat. No. 5,094,344), Sailboard carrying apparatus (U.S. Pat. No. 4,724,989), Surfboard or sailboard carrier (U.S. Pat. No. 5,823,551), System transport of machine water sport as, for example the windsurfing (2490597), Transport protection for surfing equipment (3225842), Carrying harness for rectangular or oval body and accessories (8501194), Board sling (20050236450) and Devices and Methods for Carrying and Storing a Surfboard (20080057805).

All the above designs have had some deficiency in their approach. Two of the above patents U.S. Pat. Nos. 3,591,063 and 5,823,551 each require the use of at least one hand, thereby limiting the user's ability to carry other important equipment such as a wetsuit, cooler, towel, etc.

U.S. Pat. No. 3,777,007, PCT 8501194 and PCT 20080057805 each consist of two straps and some initial setup adjustments prior to use for the size of the surfboard and size of the user. A new setup would be required for a different user or a different size surfboard. This increases the time to utilize the device and discourages its use.

U.S. Pat. Nos. 4,483,380, 4,724,989 and 4,804,025 each utilize bars or rods in their approach. This complicates the assembly, has multiple parts and when not in use these bars and rods require additional area when transporting and storing them.

U.S. Pat. No. 5,094,344, PCT 20050236450, German Pat. No. 3225842 and France Pat. No. 2490597 are carrier style bags or blankets. The bag/blanket approach requires enough material to cover the surfboard which increases the cost to manufacture, store and ship.

Besides the deficiencies as described above, all of these solutions miss the one key element of the problem: a user needs to carry surfboards both to and from the water's edge. The ocean is a dynamic environment such that the entry and exit point of the water may not be the same. The ocean's longshore currents (side currents) could move the user hundreds of yards down the shore from where they entered. Therefore, what is needed is an apparatus that can go with the user into the water and be readily available for use upon exiting the water.

BRIEF SUMMARY OF THE INVENTION

In accordance with one embodiment, a wearable sports equipment carrier comprises a primary loop, a buckle that can slide along the primary loop and a strap element extending past the primary loop attachment point. The strap element, working with the buckle creates a secondary adjustable secondary loop having a user-defined size. The user can carry a surfboard or other object by using the primary loop over a shoulder and the secondary adjustable secondary loop around the surfboard. When not utilized as a carrier, the device can be worn, such as a belt. To use as a belt, the user keeps the primary loop compressed together, wraps the carrier around his/her waist, through the buckle and then attaches it back onto itself. The carrier may also include a second shoulder strap to allow the load to be carried on the back and share the weight between both shoulders.

Accordingly, several advantages of one or more aspects are as follows: 1) the single strap carrier solution is very simple which makes it convenient and easy to use, 2) the weight of the object being carried causes the secondary adjustable secondary loop to auto-tighten due to gravity ensuring that the surfboard or other object is securely held in place allowing hands free operation, 3) the adjustability of the secondary loop allows a single embodiment to wrap many sizes surfboards or other objects and adjusts from a child size to a grown male adult, 4) the carrier can be made from a soft material that will not damage the surfboard, 5) the single strap carrier design conveniently converts to a belt that allows it to travel with the user, 6) when it is not utilized to carry a surfboard or worn as a belt it can be folded together to reduce its size for convenient storage, 7) the single strap carrier embodiment also makes it less expensive to manufacture, 8) for situations where the carrier is being used to carry a heavy load, a second strap can be used to share the weight on both shoulders, thus reducing the pressure one only one of a user's shoulder. These and other benefits for one or more aspects will become apparent from consideration of the following description and accompanying drawings.

Figure 1:
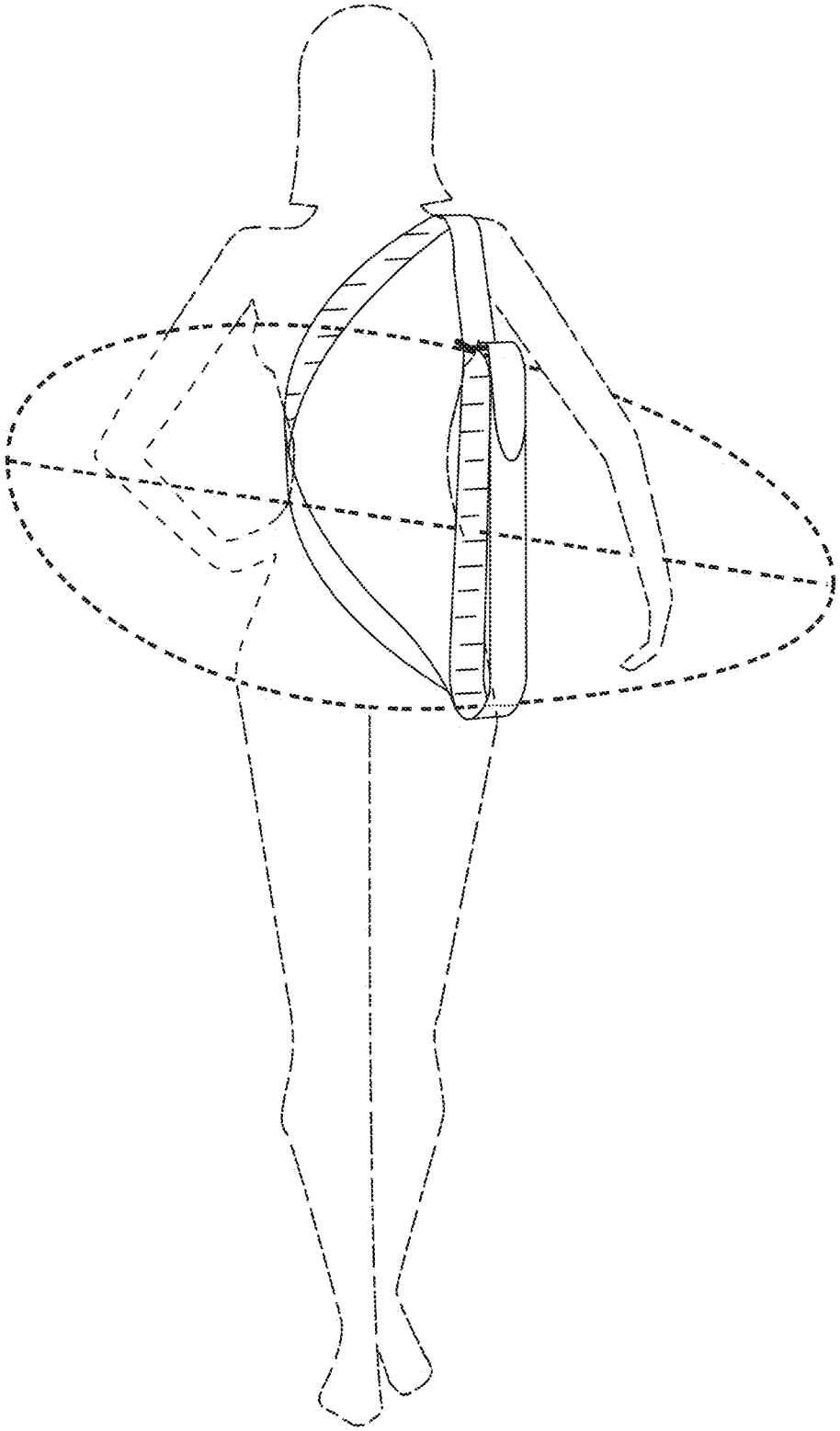
FIG. 1 shows a perspective view of a wearable sports equipment carrier carrying a surfboard.

The dashed lines of the individual, surfboard and bucket shown in FIG. 1, FIG. 2, FIG. 5, FIG. 6, FIG. 7, FIG. 8, FIG. 10, FIGS. 29 and 30 are for illustrative purpose only and form no part of the claimed design. The wearable sports equipment carrier is shown with broken away lines in FIGS. 3 and 12-15 to indicate indeterminate length.

Following is a list of Item Reference Numerals shown in the Drawings:

sports equipment carrier 10
surfboard 12
strap element 20
sewn bend 21
loop buckle 22
two opening loop buckle (tri-glide buckle) 22A
D Ring 22B
ladder lock buckle 22C
quick release buckle 22D
female connector 22F
male connector 22M
ladder lock adjuster 23
ladder lock friction bar 23A
primary loop element 24 (can be used like a shoulder strap)
upper primary loop element 24A
lower primary loop element 24B
adjustable secondary loop element 25 end junction point 26 (where the webbing is attached to itself to form a primary loop)
junction point 26A (where the webbing is attached to an object cradle 27 to form a primary loop)
object cradle 27
tongue 28 (can be the end of the webbing or made with hook fastener)
sewn bend 29
attachment-surface 30 (can be made with a loop fastener)
hook length-reducer 32 (can be made with a hook fastener)
loop length-reducer 34 (can be made with a loop fastener)
personal flotation device 36 (can be attached to the strap element 20)
tri-glide buckle 37
female buckle 38
male buckle 40
strap buckle extender 42
primary loop element assembly 44 (consists of a primary loop element 24, a loop buckle 22, a strap buckle extender 42, a female buckle 38, another strap buckle extender 42 and a male buckle 40)
hook fastener patch 48
weight distribution belt 50
weight transfer strap 52
loop fastener patch 58
slot opening 60
object retainer strap 62
object retainer loop 64
center point manacle 66
shoulder pad 68

DETAILED DESCRIPTION OF THE INVENTION

Figure 2:
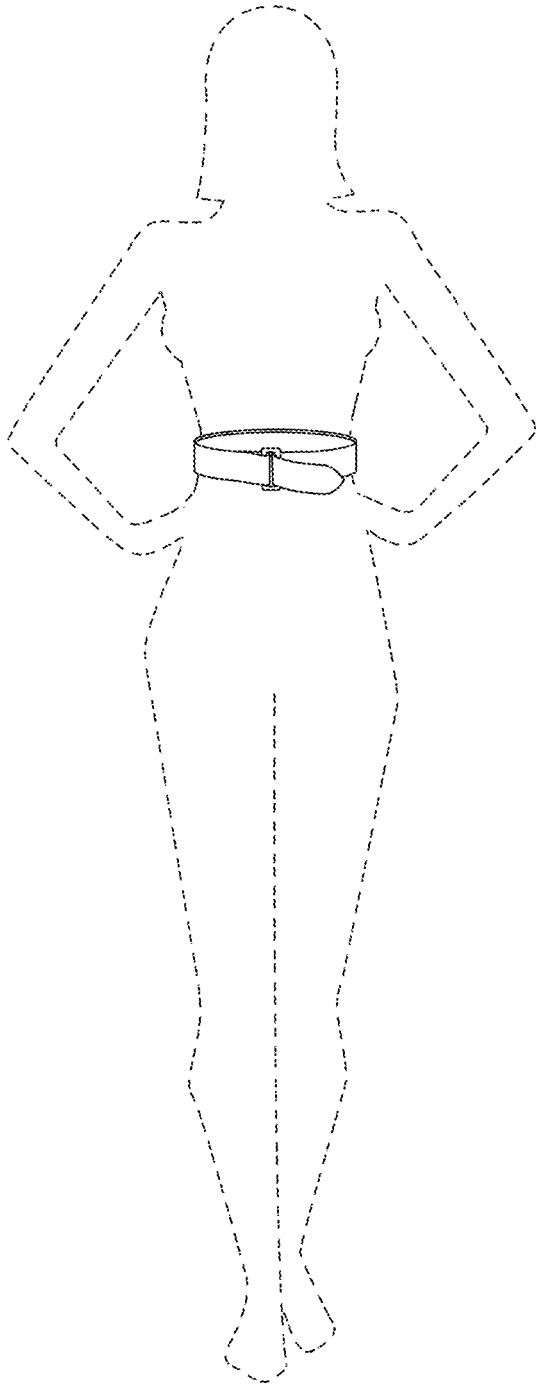
FIG. 2 shows a perspective view of a wearable sports equipment carrier being worn as a belt.

A wearable sports equipment carrier 10 according to embodiments of the disclosed invention is shown in FIGS. 1 and 2. In FIG. 1, the carrier 10 is being used to carry a surfboard 12. In FIG. 2, the carrier 10 is being worn as a belt, providing the hands-free portability advantages discussed above.

Figure 3:
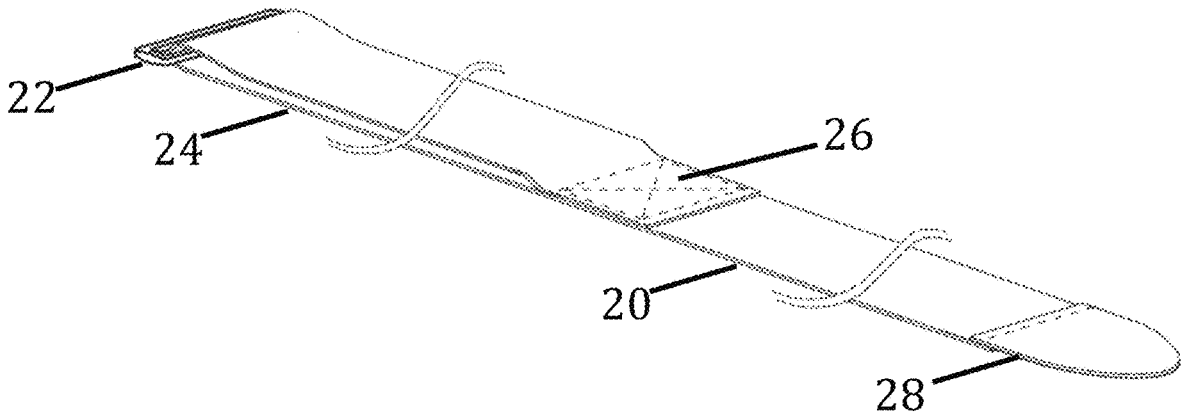
FIG. 3 shows a perspective view of a sports equipment carrier.

One embodiment of the wearable sports equipment carrier 10 is shown in FIG. 3. The carrier 10 is preferably fabricated from a polyester, polypropylene or nylon webbing but can be fabricated from any thin flexible strap, belt or equivalent material. While dimensions can vary, a reasonable size is generally about 5.08 cm (2") wide and 2.44 m (8') long. In general, pieces attaching to this webbing share its width (5.08 cm (2")) and only the length will be specified. Furthermore, it shall be assumed that throughout this description the attachment method for attached pieces will be sewing or some other suitable method.

One end of the webbing is inserted through a free moving loop buckle 22 and folds back and attaches to itself to form a primary loop element 24. The length of the webbing used to form the attachment junction point 26 should be sufficient length to provide a good connection for the type of material used; generally, about 5.08 cm (2") long works well. The primary loop element 24 length can be chosen for the size of the person using the carrier and the object to be carried. Additionally, with some selection in primary loop 24 and strap element 20 lengths the wearable sports equipment carrier can accommodate a variety of different size surfboards and users. Generally, about ⅔ the length of the webbing material is used to form the primary loop element 24 leaving approximately ⅓ its length leftover after the end junction point 26 to form a strap element 20.

Figure 4:
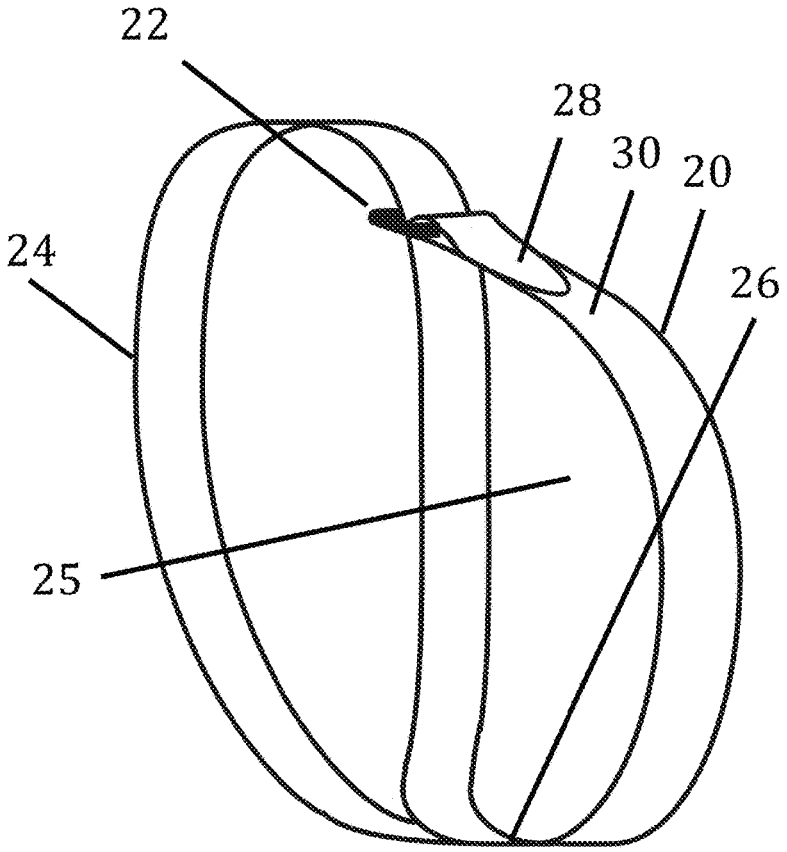
FIG. 4 shows a perspective view of a wearable sports equipment carrier without user and without surfboard.
Figure 5:
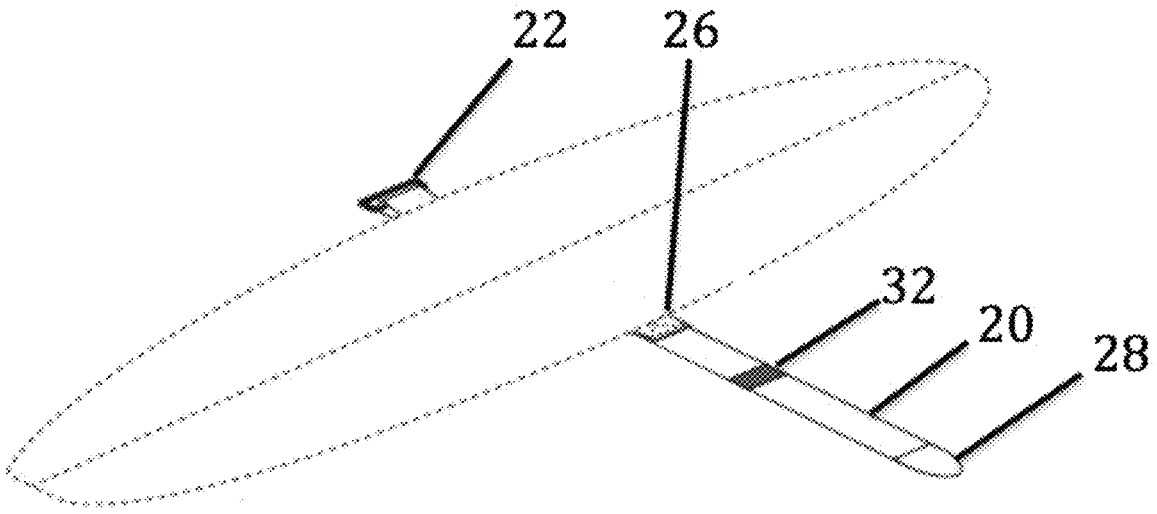
FIG. 5 shows a perspective view of a wearable sports equipment carrier under a surfboard.
Figure 6:
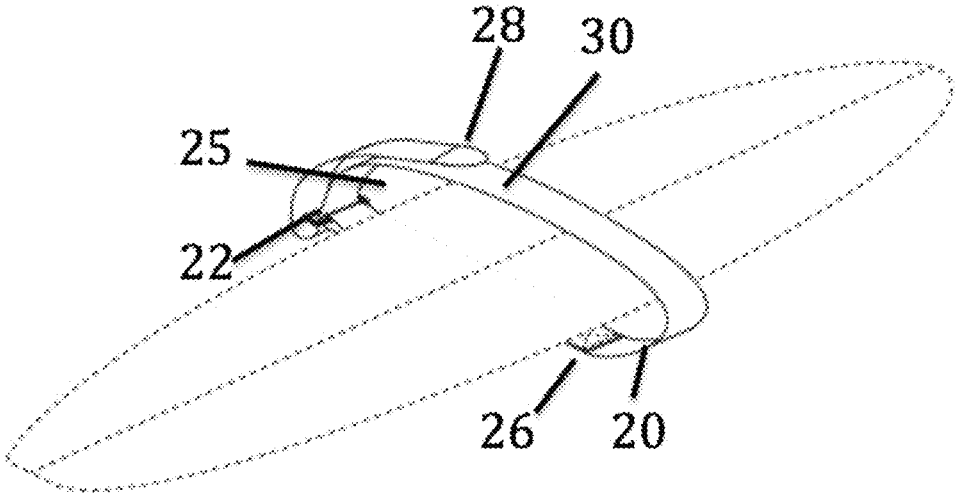
FIG. 6 shows a perspective view of a wearable sports equipment carrier being wrapped around a surfboard.
Figure 7:
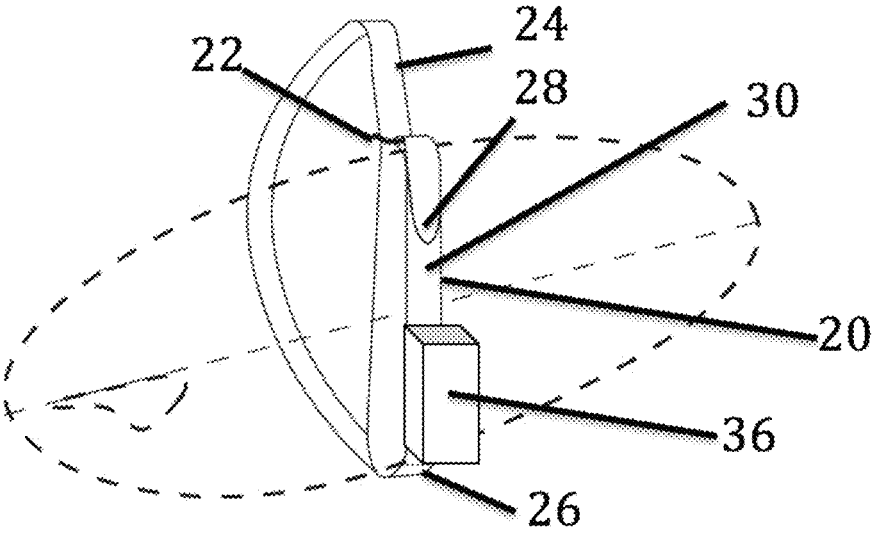
FIG. 7 shows a perspective view of a wearable sports equipment carrier lifting a surfboard and includes a personal flotation device.

At the end of the strap element 20 can be a tongue 28 which can be made using a hook fastener. The tongue 28 length can vary but generally about 5.08 cm (2") long is a sufficient to form a good attachment when mated to a loop fastener. When hook fastener is used the hook attaches to the webbing so that the hook's surface is on the opposite side of the webbing from the junction point 26. That is, if the webbing is held horizontal, with the junction point 26 facing up then the hook surface would be facing down (see FIGS. 13 and 14). If the tongue 28 was made from a hook fastener, then attachment-surface 30 would be made from a loop fastener. The attachment-surface 30 attaches to the webbing so that the loop surface faces the same direction as the hook surface of the tongue 28. The attachment-surface 30 can extend the entire length of the wearable sports equipment carrier with the one edge beginning at the tongue 28 and the other the edge ending at the primary loop 24 center fold-over point (see FIG. 14). However, its length can be reduced and chosen for the waist size of its largest user. Generally, a size of at least 1.1 m (44") works well to accommodate extra large waist size (XXL). The hook and loop of connecting surfaces face the same direction so that when the tongue 28 passes through the loop buckle 22 and folds back towards the attachment-surface 30 they can form a hook/loop type attachment (FIG. 4).

The wearable sports equipment carrier 10 can be used to carry a surfboard 12 or other object (SUP, snowboard, snow skis, sports equipment bags, mountain bicycles, firewood, lumber, concrete, paint buckets, roofing material, etc.) by wrapping it around the lengthwise center of the surfboard, or object, at roughly the center of mass. To utilize the carrier, the user can lay the carrier with the hook surface of the tongue 28 facing the ground. Slide the loop buckle 22 to approximately the center fold-over point of the primary loop 24 leaving it easily accessible when the surfboard is in place. Lay the surfboard onto the carrier so its approximate center of mass is on top of the carrier and the length of the surfboard is perpendicular to the length of the carrier (see FIG. 5). Position the surfboard so that one lengthwise edge of the surfboard is approximately over the end junction point 26 of the carrier and the other lengthwise edge of the surfboard is nearest to the loop buckle 22. This should leave the strap element 20 uncovered. Take the tongue 28 with the strap element 20 and wrap it over the surfboard and feed it through the loop buckle 22 and back onto attachment-surface 30 to form a hook/loop type attachment (see FIG. 6). This attachment produces a secondary adjustable secondary loop.

Increasing the distance from loop buckle 22 to the end of the tongue 28 decreases the secondary loop for a narrower surfboard or a shorter person. Conversely, decreasing the distance from loop buckle 22 to the end of the tongue 28 increases the secondary loop size for a wider surfboard or taller person. This adjustment is best performed when the surfboard is held in place by the secondary adjustable secondary loop and the carrier is on the user (see FIG. 1). Thus, it is easiest to start with a larger secondary adjustable secondary loop by attaching the tongue 28 close to the loop buckle 22 and then reduce it to the desired size. Next, pull the webbing of the primary loop 24 away from the loop buckle 22 which causes the secondary loop to tighten around the surfboard. By lifting the primary loop 24 up, the surfboard can be transitioned to a vertical position (see FIG. 7) where the surfboard's weight causes the secondary adjustable secondary loop to tighten holding the surfboard in place. Thus, the wearable sports equipment carrier is auto-tightening due to gravity to hold a surfboard securely in place. The primary loop 24 portion of the carrier can be used to hang on a shoulder or across the body of the user to carry a surfboard (see FIG. 1 for a user with a surfboard or FIG. 4 for the carrier by itself).

While an embodiment(s) of the wearable sports equipment carrier 10 has distinct advantages over one or more aspects of prior art in that it is quick to install (approximately 15 seconds), is auto-tightening due to gravity (holding the surfboard in place), and is easily adjustable for many sizes (in seconds), it also has the distinct advantage over prior art for its ability to convert into a belt and travel with the user.

This wearable belt configuration is accomplished by putting the carrier in a full-length position and sliding the loop buckle 22 to the end which is approximately the center fold-over point of the primary loop 24. The user shall position the carrier around the waist of his/her body with the loop buckle 22 in one hand and the tongue 28 in the other with both the hook and loop surfaces facing away from the body. Take the tongue 28 of the strap element 20 and wrap it around the waist and feed it through the loop buckle 22 and fold it back onto the attachment-surface 30 forming a belt held in place by the hook/loop type attachment (see FIG. 2).

Figure 14:
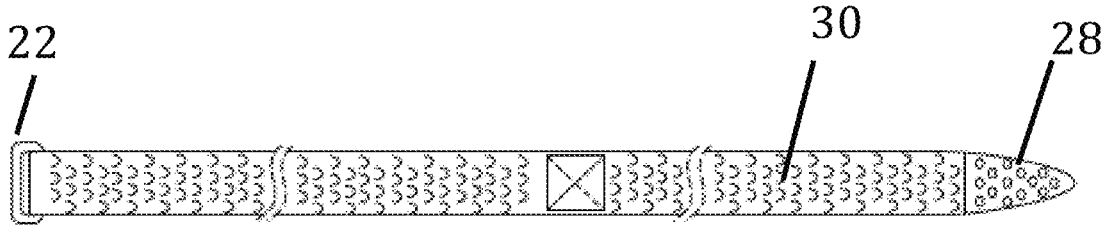
FIG. 14 shows a bottom plan view of the carrier.
Figure 15:
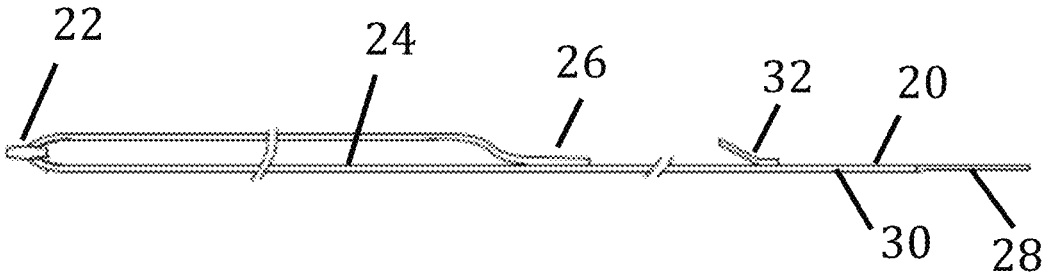
FIG. 15 shows a left elevation view of the carrier.
Figure 16:
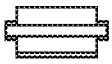
FIG. 16 shows a front elevation view of the carrier.
Figure 17:
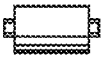
FIG. 17 shows a rear elevation view of the carrier.

Another embodiment(s) of wearable sports equipment carrier can be made for users whose waist size is proportionally smaller with respect to the width of the surfboard. For this embodiment, the user makes a smaller belt by first folding the carrier back on itself. To do this, a hook length-reducer 32 and a loop length-reducer 34 are added to the carrier (see FIGS. 8 & 9). The loop reducer 34 is not required if the attachment-surface 30 extends the entire length of the wearable sports equipment carrier as shown in FIG. 14. The loop reducer 34 can be made from loop fastener with a length about 3.81 cm (1.5") long. The loop reducer 34 is attached with its loop surface facing out and on the same side as the attachment-surface 30. It is attached so that it is edge-to-edge with the center fold-over point of the primary loop 24.

The hook length-reducer 32 can be made from a hook fastener with a length of 6.35 cm (2.5"). The hook reducer 32 is positioned so that when the hook/loop connection is made the folded carrier length becomes the same length as the attachment-surface 30 as described above (for example 1.1 m (44")). When a folded carrier has an attachment-surface 30 length of 1.1 m (44") the carrier will accommodate a waist size from 1.1 m (44") down to half that length or 0.55 m (22"). The hook reducer 32 is attached on the same side of the webbing as the junction point 26. In this embodiment, it is preferable to attach the hook reducer 32 with the hook surface facing in towards the webbing (the reason for this will soon become evident). In addition, attach only a portion (approximately 20%) of the hook material (approximately 1.27 cm (0.5")) to the webbing leaving the majority of the hook surface (5.08 cm (2")) available to fold up and mate with the loop.

Attaching the hook surface facing the webbing has two advantages. The first advantage is that the smooth side, and not the hook surface, is exposed to surface wax when wrapping and carrying a surfboard. This prevents wax build up on the hook surface interfering with its ability to function as loop fastener receiver. The second advantage increases the structural strength of the hook and loop connection. The ocean can be a turbulent environment with many forces acting at many angles. With the hook facing the webbing it takes more perpendicular force upon the strap element 20 to break the hook/loop connection and thus there is a lower probably the ocean will break their attachment apart resulting in the loss of the belt.

Figure 8:
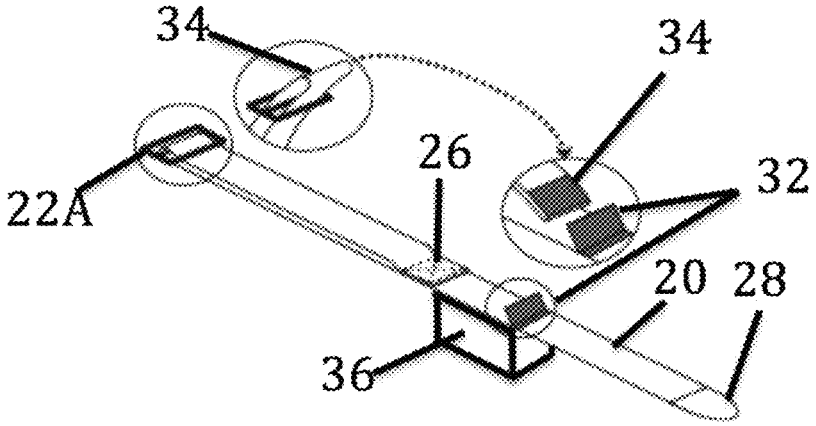
FIG. 8 shows a perspective view of a wearable sports equipment carrier folding down to reduce the belt size and includes a personal flotation device.
Figure 9:
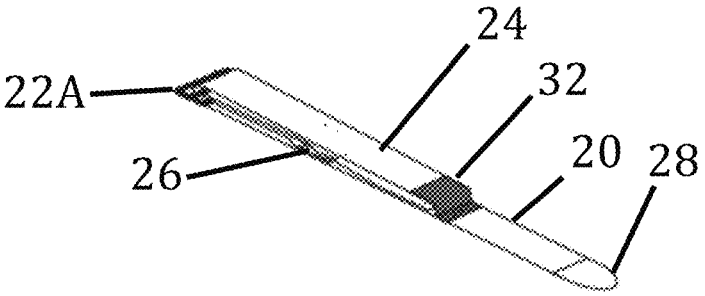
FIG. 9 shows a perspective view of a wearable sports equipment carrier folded to become a belt laid flat.
Figure 10:
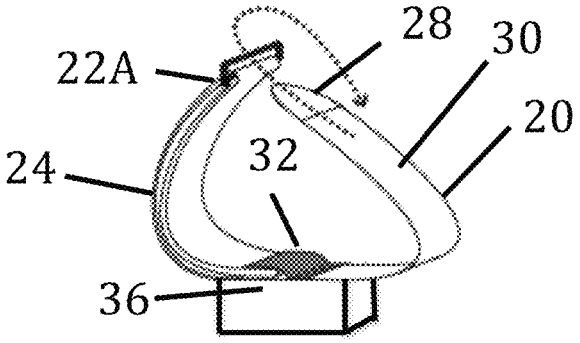
FIG. 10 shows a perspective view of a wearable sports equipment carrier wrapping as a belt.
Figure 11:
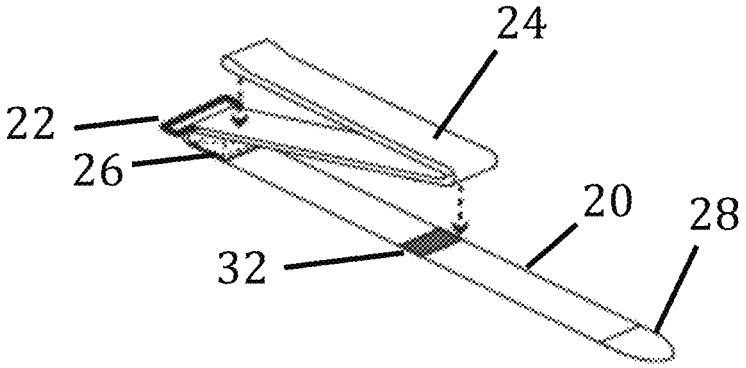
FIG. 11 shows a perspective view of a wearable sports equipment carrier making two folds to reduce the belt size.
Figure 12:
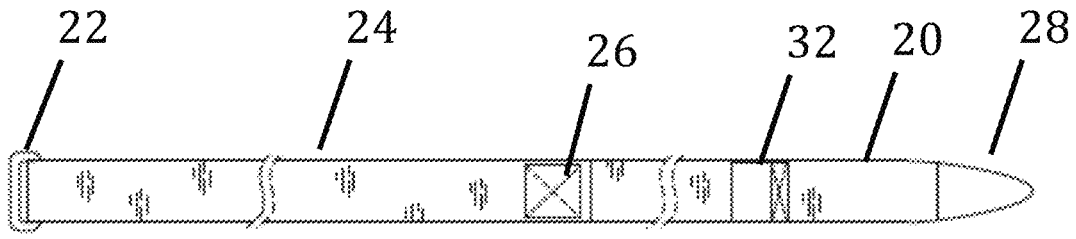
FIG. 12 shows a top plan view of the carrier.
Figure 13:
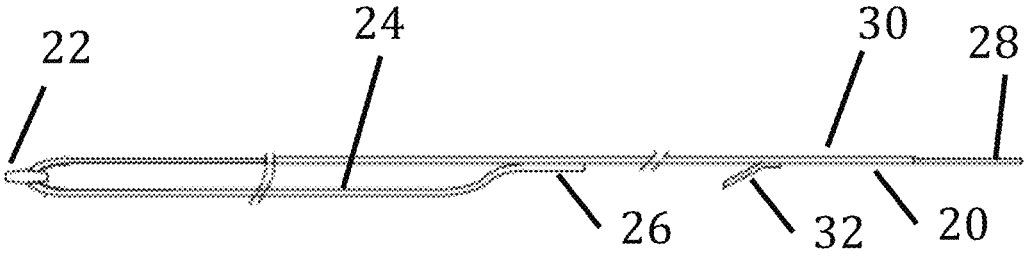
FIG. 13 shows a right elevation view of the carrier.

As described above, the attachment-surface 30 or loop reducer 34 can be connected to the hook reducer 32 (see FIG. 8). This folded carrier makes for a smaller belt (see FIG. 9). When using this length shortening technique a two opening loop buckle 22A (see FIG. 8) is preferred over a standard single opening loop buckle 22 (see FIG. 3). When the carrier is folded over to be worn as a belt the second inner opening of the two opening loop buckle 22A holds the inner fold of the webbing in place when it is in the folded position (see FIGS. 9. and 10). This prevents the inner fold from being dislodged in the ocean's turbulent environment and reducing the tension on the belt.

Figure 18A:
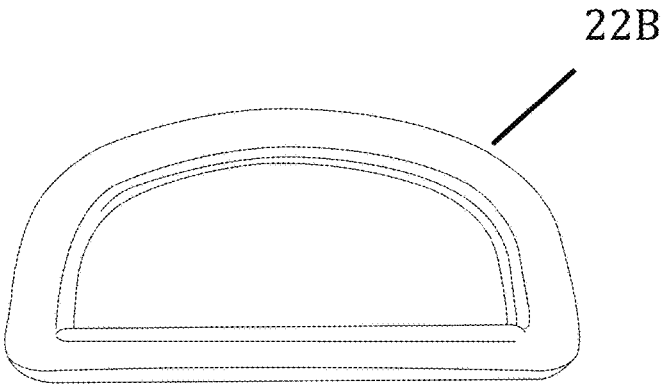
FIG. 18A shows a D Ring.

Another embodiment(s) of wearable sports equipment carrier 10 can use a pair of D rings 22B (see FIG. 18A) in place of the loop buckle 22 (see FIG. 3). It is constructed in a similar fashion with one end of the webbing inserted through two free moving D rings 22B and folds back and attaches to itself to form a primary loop element 24. The D rings 22B are allowed to slide along the length of the primary loop 24 so when the D rings 22 are utilized they can move along the length of the primary loop element 24 performing the gravity auto tightening feature as in loop buckle 22 embodiment. The advantage of this embodiment over loop buckle 22 embodiment is in the reduction of manufacturing cost of using hook and loop fastener for the tongue 28 and attachment-surface 30.

To utilize the carrier the strap element 20 is coupled to the D rings 22. This is performed by pulling the tongue 28 of the strap material 20 through the D rings 22B to a desired length then route the tongue 28 back over the closest D ring 22*b* and under the next D ring 22*b* removing all the slack of strap material 20. The friction force imposed by D rings 22B upon strap element 20 prevents the movement of the strap element 20, as should be apparent to one skilled in the art, whereupon this attachment produces the secondary adjustable secondary loop element 25. The "length" of the adjustable secondary loop 25 is selectively adjusted through manipulation of the D rings 22. Once this attachment is made the operation of the wearable sports equipment carrier 10 is the same as with the loop buckle 22 embodiment.

Figure 18:
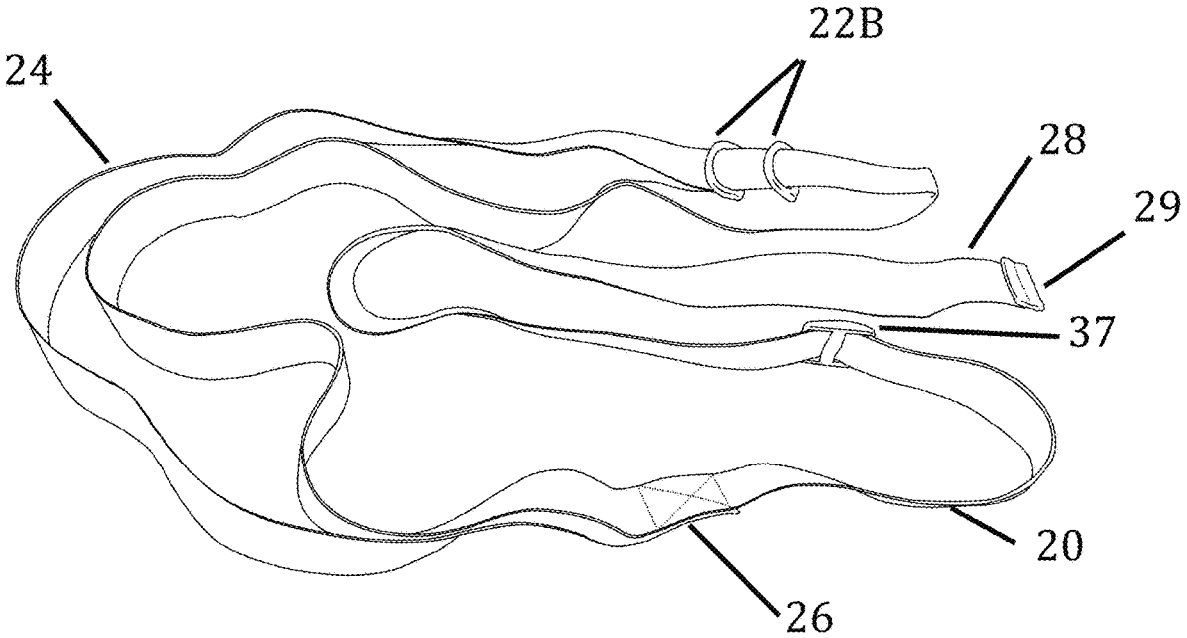
FIG. 18 shows a wearable sports equipment carrier with the buckle being D rings.

This wearable belt configuration is accomplished by putting the carrier in a full-length position and sliding the pair of D rings 22B to the end which is approximately the center fold-over point of the primary loop 24. The user shall position the carrier around the waist of his/her body with the pair of D rings 22B in one hand and the tongue 28 in the other. Take the tongue 28 of the strap element 20 and wrap it around the waist and feed it through the pair of D rings 22B and returning tongue 28 back over the closet D ring 22B and under the next D ring 22*b* pulling the tongue 28 until the strap material 20 feels tight around the waist (see FIG. 2). If desired, the tongue 28 and balance of the strap element 20 can inserted through a tri-glide buckle 37 (see FIG. 18) which is now used to take up the slack by pulling the surfaces of the folded strap element 20 together and taunt in the same way a common belt uses a tri-glide buckle 37, as should be apparent to one skilled in the art.

Another embodiment(s) of wearable sports equipment carrier 10 can use a ladder lock 22C (see FIG. 19A) in place of the loop buckle 22 (see FIG. 3). It is constructed in a similar fashion with one end of the webbing inserted through the outmost loop of a free moving ladder lock 22C (see FIG. 19) and folds back and attaches to itself to form a primary loop element 24. The ladder lock 22C is allowed to slide along the length of the primary loop 24 so when the ladder lock 22C is utilized it can move along the length of the primary loop element 24 performing the gravity auto tightening feature as in loop buckle 22 embodiment. The advantage of this embodiment over loop buckle 22 embodiment is in the reduction of manufacturing cost of using hook and loop fastener for the tongue 28 and attachment-surface 30.

Figure 19A:
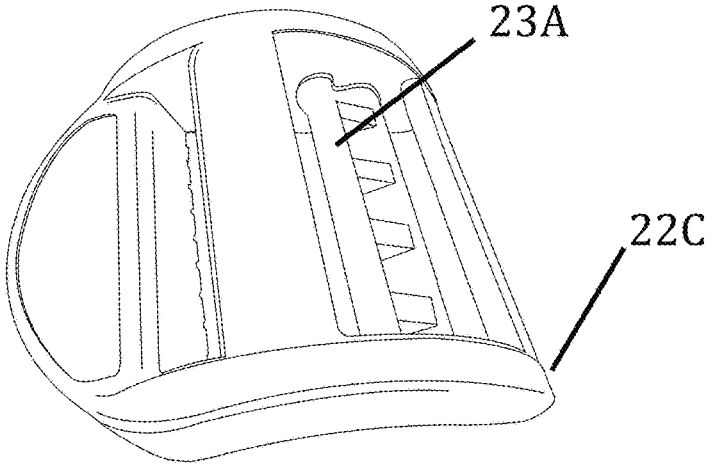
FIG. 19A shows a ladder lock.
Figure 19:
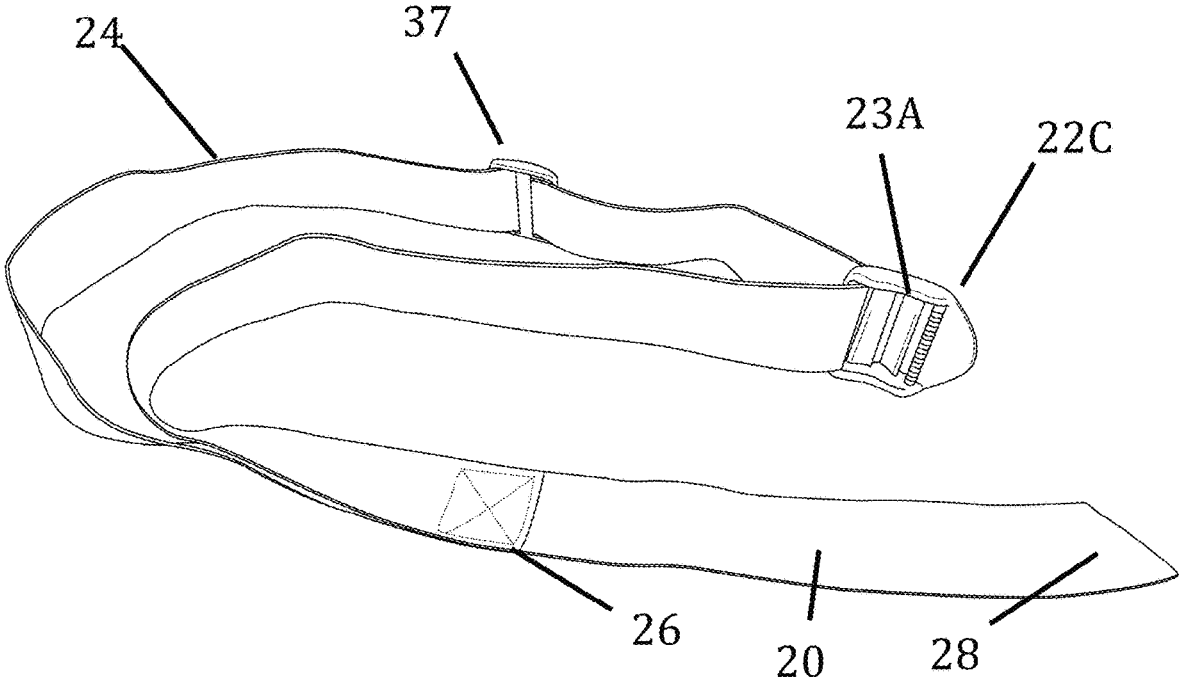
FIG. 19 shows a wearable sports equipment carrier with the buckle being a ladder lock.

To utilize the carrier the strap element 20 is coupled to a ladder lock 22C using the ladder lock friction bar 23A (see FIG. 19A). This is performed by pulling the tongue 28 of the strap material 20 through ladder lock 23 to a desired length then route the tongue 28 back over the ladder lock friction bar 23A so that the strap element 20 partially encircles the ladder lock friction bar 23A and removes all the slack of strap material 20. The friction force imposed by the ladder lock friction bar 23A upon strap element 20 prevents the movement of the strap element 20, as should be apparent to one skilled in the art, whereupon this attachment produces the secondary adjustable secondary loop element 25. The "length" of the adjustable secondary loop 25 is selectively adjusted through manipulation of the ladder lock 22C. Once this attachment is made the operation of the wearable sports equipment carrier 10 is the same as with the loop buckle 22 embodiment.

This wearable belt configuration is accomplished by putting the carrier in a full-length position and sliding the ladder lock 22C to the end which is approximately the center fold-over point of the primary loop 24. The user shall position the carrier around the waist of his/her body with the ladder lock 22C in one hand and the tongue 28 in the other. Take the tongue 28 of the strap element 20 and wrap it around the waist and feed it through the ladder lock 22C and returning tongue 28 back over the ladder lock friction bar 23A so that the strap element 20 partially encircles the ladder lock friction bar 23A pulling the tongue 28 until the strap material 20 feels tight around the waist (see FIG. 2). If desired, the tongue 28 and balance of the strap element 20 can inserted through a tri-glide buckle 37 (see FIG. 19) which takes up the slack by pulling the surfaces of the folded strap element 20 together and taunt in the same way a common belt uses a tri-glide buckle 37, as should be apparent to one skilled in the art.

Figure 20A:
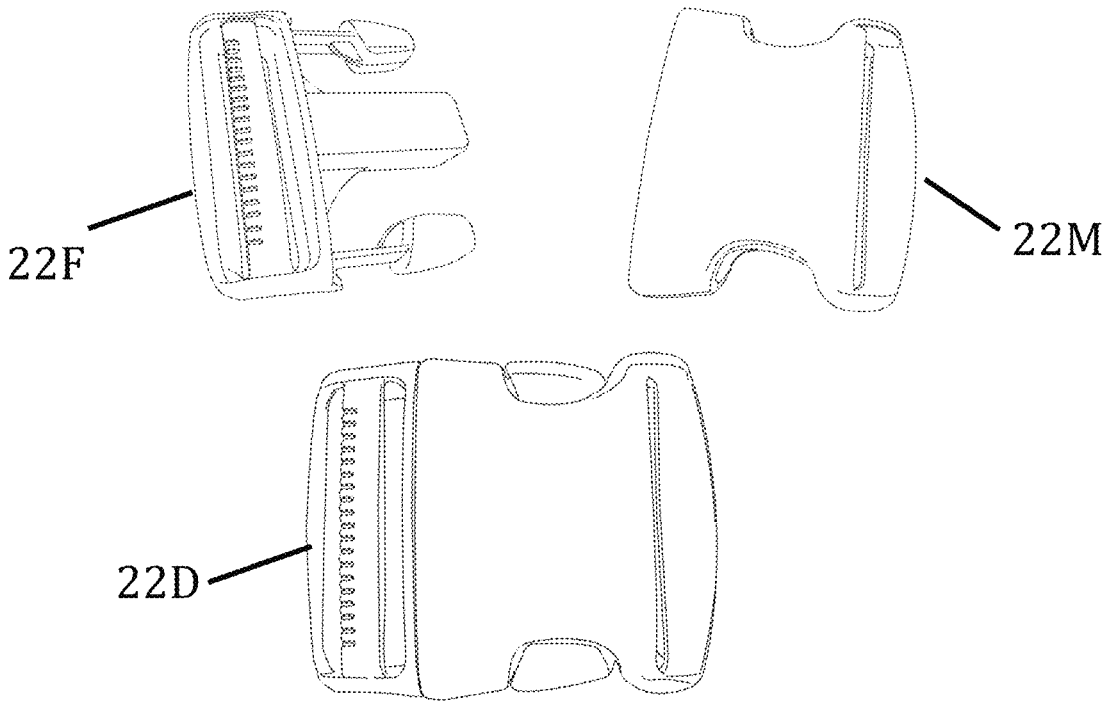
FIG. 20A shows a quick release buckle, a female connector and a male connector.

Another embodiment(s) of wearable sports equipment carrier 10 can use a releasable securing connector takes the form of a pair of mateable connector members commonly known as a quick release buckle 12D. The quick release buckle 12D is composed of a male connector 12M and a female connector 12F (see FIG. 20A). This embodiment (s) uses female connector 22F in place of the loop buckle 22 (see FIG. 3). It is constructed in a similar fashion with one end of the webbing inserted through the outmost loop of a free moving female connector 22F (see FIG. 20) and folds back and attaches to itself to form a primary loop element 24. The female connector 22F is allowed to slide along the length of the primary loop 24 so when the female connector 22F is utilized, connected to the male connector 22M, it can move along the length of the primary loop element 24 performing the gravity auto tightening feature as in loop buckle 22 embodiment. The male connector member 12M is secured in such a fashion that it can adjustably slide along the available length of the strap element 20. The free end of the strap element 20, the tongue 28, is threaded through the integrally associated ladder lock portion of the male connector 12M. Thus, male connector member 12M is allowed to move along the unobstructed length of strap element 20 extending through its integrally associated ladder lock portion of the male connector 12M. The friction force imposed by the integrally associated ladder lock of the male connector 12M upon strap element 20 prevents the movement of the strap element 20, as should be apparent to one skilled in the art. The free end of the strap element, the tongue 28, is folded back on itself and attached forming a sewn bend 29 which prevents the male connector 12M from sliding off the end of the strap element 20 (tongue 28). The advantage of this embodiment over loop buckle 22 embodiment is in the reduction of manufacturing cost of using hook and loop fastener for the tongue 28 and attachment-surface 30.

To utilize the carrier the male connector 12M is coupled to the female connector 12F and their union, the quick release buckle 12D, forms the secondary adjustable secondary loop element 25. The "length" of the adjustable secondary loop 25 is selectively adjusted through manipulation of the male connector 12M, usually adjusted before mating to the female connector 12F. Once this attachment is made the operation of the wearable sports equipment carrier 10 is the same as with the loop buckle 22 embodiment.

This wearable belt configuration is accomplished by putting the carrier in a full-length position and sliding the female connector 22F to the end which is approximately the center fold-over point of the primary loop 24. The user shall position the carrier around the waist of his/her body with the female connector 22F in one hand and the male connector 22M in the other. Take the male connector 22M of the strap element 20 coupling it to the female connector 12F, the quick release buckle 12D, and then through manipulation of the male connector 12M, pulling the tongue 28 away from the male connector 12M, until the strap material 20 feels tight around the waist (see FIG. 2). If desired, the tongue 28 and balance of the strap element 20 can inserted through a tri-glide buckle 37 (see FIG. 20) which is now used to take up the slack by pulling the surfaces of the folded strap element 20 together and taunt in the same way a common belt uses a tri-glide buckle 37, as should be apparent to one skilled in the art.

Another embodiment(s) of a wearable sports equipment carrier 10 would be simply swapping the locations of the male connector 12M and the female connector 12F of the previous embodiment above.

Figure 21A:
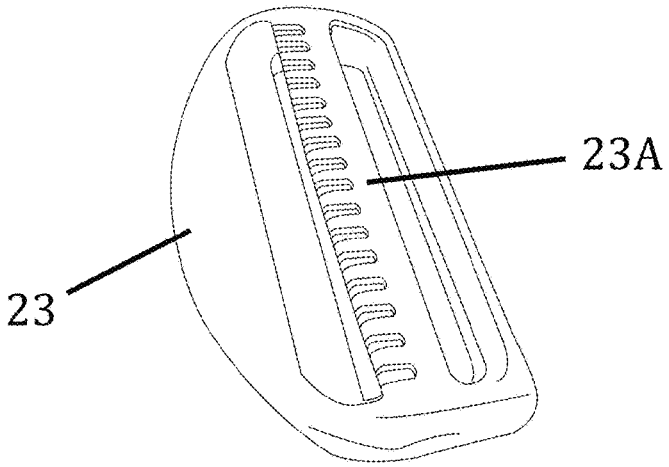
FIG. 21A shows ladder lock adjuster with a ladder lock friction bar.
Figure 21:
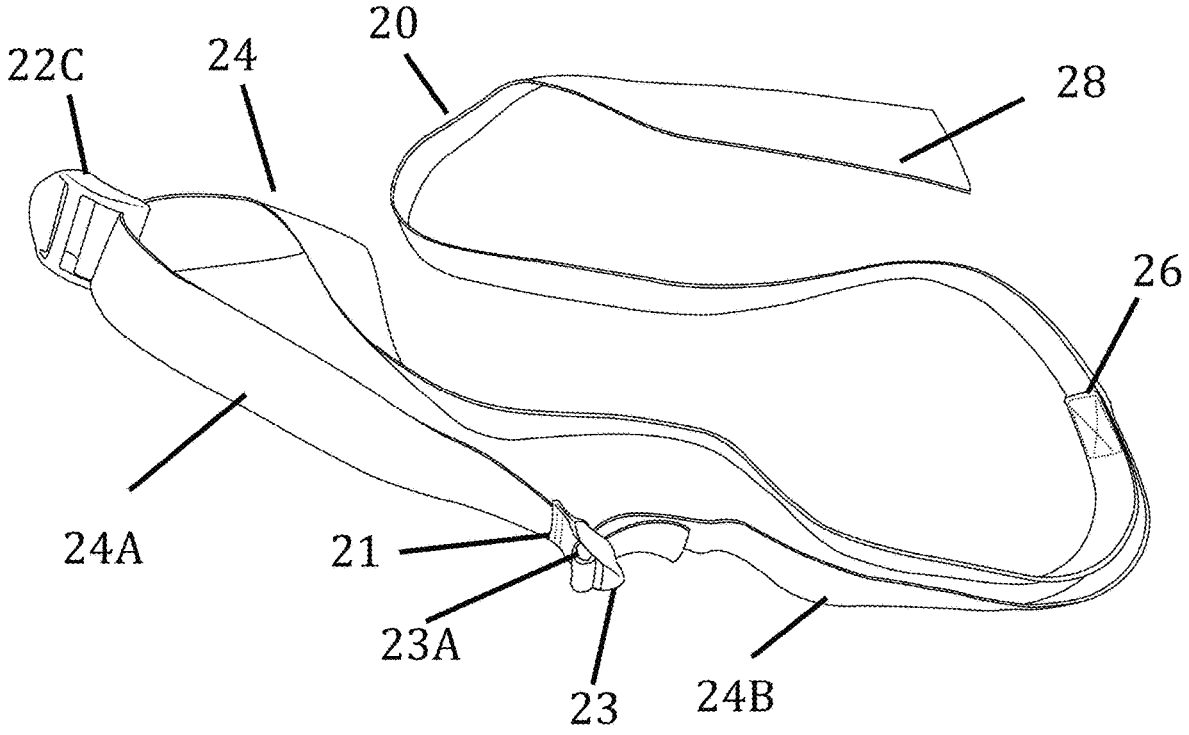
FIG. 21 shows a wearable sports equipment carrier with an adjustable primary (first) loop.

Another embodiment(s) of a wearable sports equipment carrier 10 is to make any embodiment(s) primary loop element's 24 length adjustable by dividing the primary loop element into two sections: an upper primary loop element 24A and a lower primary loop element 24B and then coupling the two sections back together via a connection element such as a ladder lock adjuster 23 (see FIG. 21). The end of the upper primary loop element 24A is secured to a ladder lock adjuster 23 by a sewn bend 21 at the end of said upper primary loop element 24A. The lower primary loop element 24B is coupled to the ladder lock adjuster 23 using the ladder lock friction bar 23A. The ladder lock adjuster 23 is operable to adjust the length of the primary loop element 24 (can be used as a shoulder strap) to provide a comfortable fit for users and objects of various sizes. The ladder lock adjuster 23 has at least one friction bar 23A of which the lower primary loop element 24B partially encircles. The friction force imposed by the ladder lock friction bar 23A upon the lower primary loop element 24B prevents the movement of the lower primary loop element 24B, as should be apparent to one skilled in the art (see FIG. 21). The "length" of the lower primary loop element 24B is selectively adjusted through manipulation of the ladder lock adjuster 23 to thereby adjust the length of the primary loop element 24. This embodiment is shown using a ladder lock 22C but it could easily be utilized on any other embodiment (s) with a different connect 22, 22A, 22B, 22D, etc. All other functionality of those embodiment(s) remain the same and will not be described here.

Figure 22:
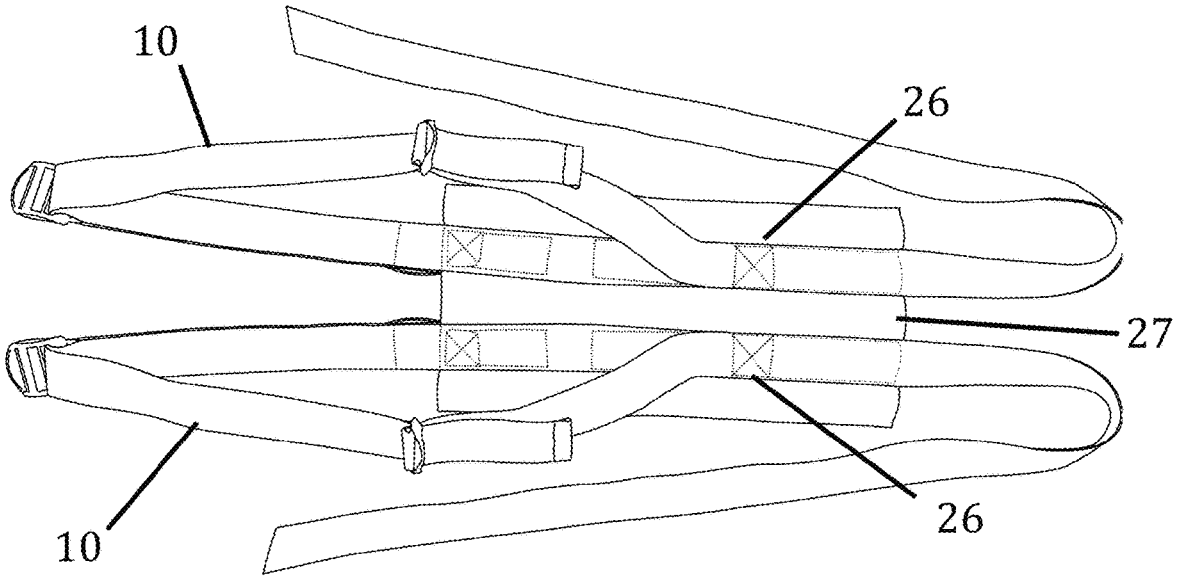
FIG. 22 shows an example of a wearable sports equipment carrier with two carriers 10 on an object cradle 27.

Another embodiment(s) of wearable sports equipment carrier 10 incorporates two carriers 10 and incorporates an object cradle 27 is shown in FIG. 22. As described earlier the carrier 10 is preferably fabricated from a polyester, polypropylene or nylon webbing. While dimensions can vary, a reasonable size is for the strap element is generally about 5.08 cm (2") wide and 2.46 m (8') long. A good choice for the object cradle 27 is between 12.70 cm (5") to 15.24 cm (6") wide and 53.34 cm (21") long and made out of the same webbing material as the strap itself. The two carriers are attached to the object 27 adjacent to each other so that both adjustable secondary loops can concurrently wrap the object to be carried and provide multiple areas of object support.

In addition, because this embodiment has two primary loop elements 24 the user has the option to separate the primary loop elements 24 apart from each other and place each primary loop element 24 over each of the user's shoulder allowing the object to be carried on user's back or front. This embodiment is shown using a ladder lock 22C but it could easily be utilized on any other embodiment(s) with a different connector 22, 22A, 22B, 22D, etc. All other functionality of those embodiment(s) remain the same and will not be described here.

Figure 23:
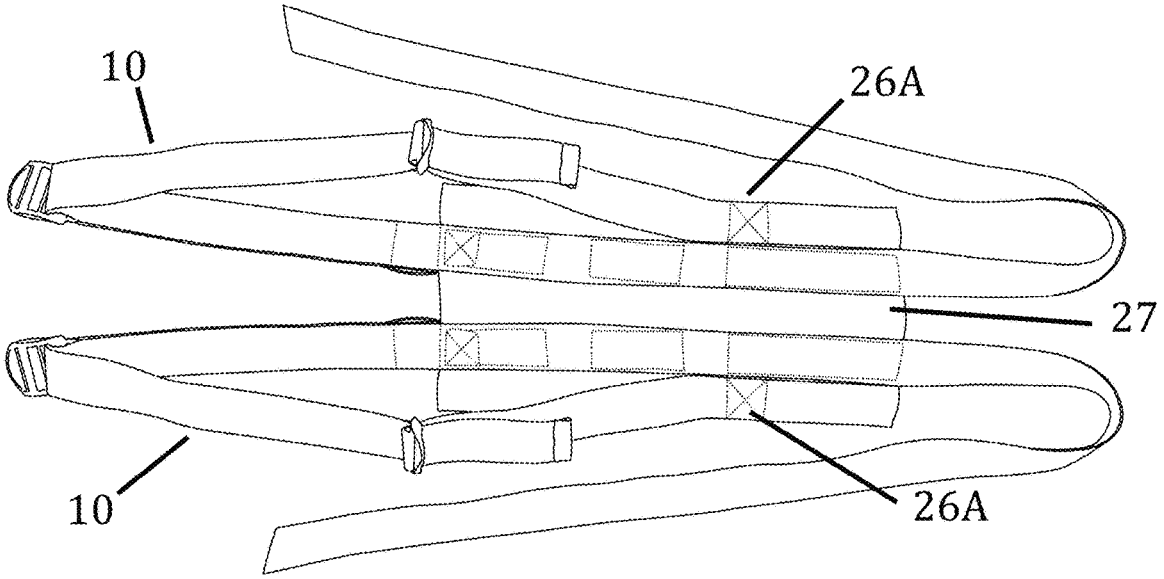
FIG. 23 shows an example of a wearable sports equipment carrier with two carriers 10 on an object cradle 27 with the attachment points adjacent to strap elements 20

Another embodiment(s) of wearable sports equipment carrier 10 also incorporates two carriers 10 and incorporates an object cradle 27. But by utilizing the object cradle 20, the primary loop(s) junction points 26 can be attachment points 26A at the side of the strap element 20 as opposed to on top of the strap element 20 allowing the two primary loops to be wider (or narrower) than the two strap elements as shown in FIG. 23. The two carriers are attached to the object 27 adjacent to each other so that both adjustable secondary loops can concurrently wrap the object to be carried and provide multiple areas of object support at a different spacing than the primary loops used for carrying.

In addition, because this embodiment has two primary loop elements 24 the user has the option to separate the primary loop elements 24 apart from each other and place each primary loop element 24 over each of the user's shoulder allowing the object to be carried on user's back or front. This embodiment is shown using a ladder lock 22C but it could easily be utilized on any other embodiment(s) with a different connector 22, 22A, 22B, 22D, etc. All other functionality of those embodiment(s) remain the same and will not be described here.

Figure 24:
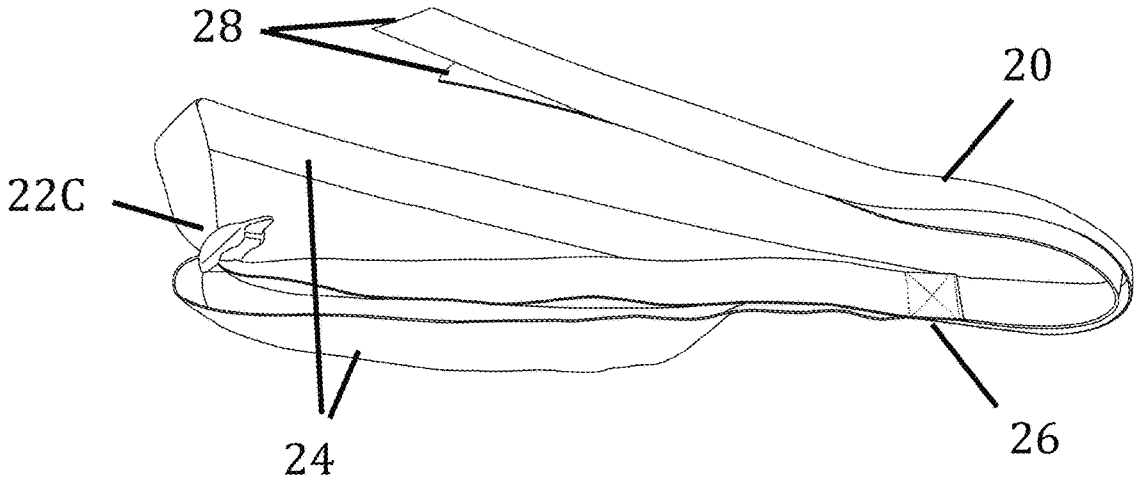
FIG. 24 shows an example of a wearable sports equipment carrier with two primary loops and two strap elements.

Another embodiment(s) of wearable sports equipment carrier incorporates two primary loop element 24 and two strap elements 20 to allow the user to carry an object over both shoulders rather than just one. This embodiment is two sports equipment carriers 10 attached together at their end junction point 26 with one end junction point 26 sewn on top of the other end junction point 26 but sharing a single ladder lock buckle 22C. The single ladder lock buckle 22 moves along the length of both primary loop elements 24 concurrently performing the gravity auto tightening feature (see FIG. 24).

This embodiment allows the user to combine both primary loop elements 24 together to carry the object over one shoulder is if it was a single primary loop element 24. This is performed by pulling both tongues 28 of both strap elements 20 through ladder lock 23 to a desired length then route both tongues 28 back over the ladder lock friction bar 23A so that both strap elements 20 partially encircles the ladder lock friction bar 23A and removes all the slack of both strap elements 20. The friction force imposed by the ladder lock friction bar 23A upon strap elements 20 prevents the movement of the strap elements 20, as should be apparent to one skilled in the art, whereupon this attachment produces the secondary adjustable secondary loop element 25. The "length" of the adjustable secondary loop 25 is selectively adjusted through manipulation of the ladder lock 22C. Once this attachment is made the wearable sports equipment carrier 10 the operates the same as with the loop buckle 22 embodiment. In addition, because this embodiment has two primary loop elements 24 the user has the option to separate the primary loop elements 24 apart from each other and place each primary loop element 24 over each of the user's shoulder allowing the object to be carried on user's back or front. This embodiment is shown using a ladder lock 22C but it could easily be utilized on any other embodiment(s) with a different connector 22, 22A, 22B, 22D, etc. All other functionality of those embodiment(s) remain the same and will not be described here.

Another embodiment(s) of wearable sports equipment carrier incorporates two primary loop elements 24 and sharing a single ladder lock buckle 22C as if it was the previous embodiment (see FIG. 24) but terminates one of the two strap elements 20 at the end junction point 26 leaving only one strap element 20 to couple with the ladder lock buckle 22C to produce the secondary adjustable secondary loop element 25. This has an advantage over the previous embodiment in that it is easier to interface the one strap element 20 with the ladder lock buckle 22C verses interfacing the two strap elements 20. This embodiment is shown using a ladder lock 22C but it could easily be utilized on any other embodiment(s) with a different connect 22, 22A, 22B, 22D, etc. All other functionality of those embodiment(s) remains the same and will not be described here.

Figure 25:
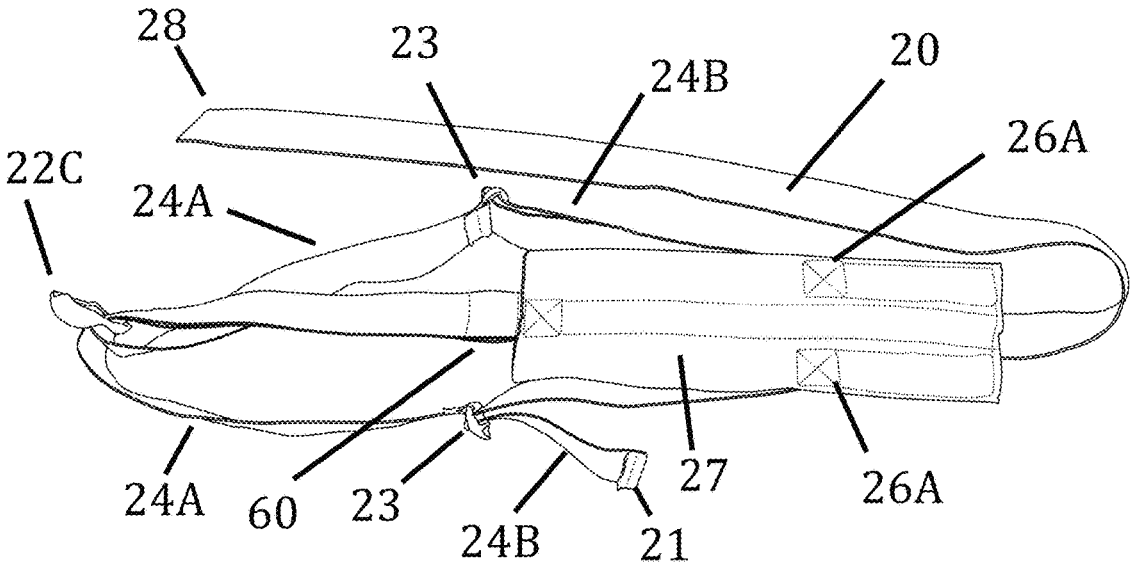
FIG. 25 shows a top view of a wearable sports equipment carrier with two primary loops, an object cradle 27 and two adjacent junction points.
Figure 26:
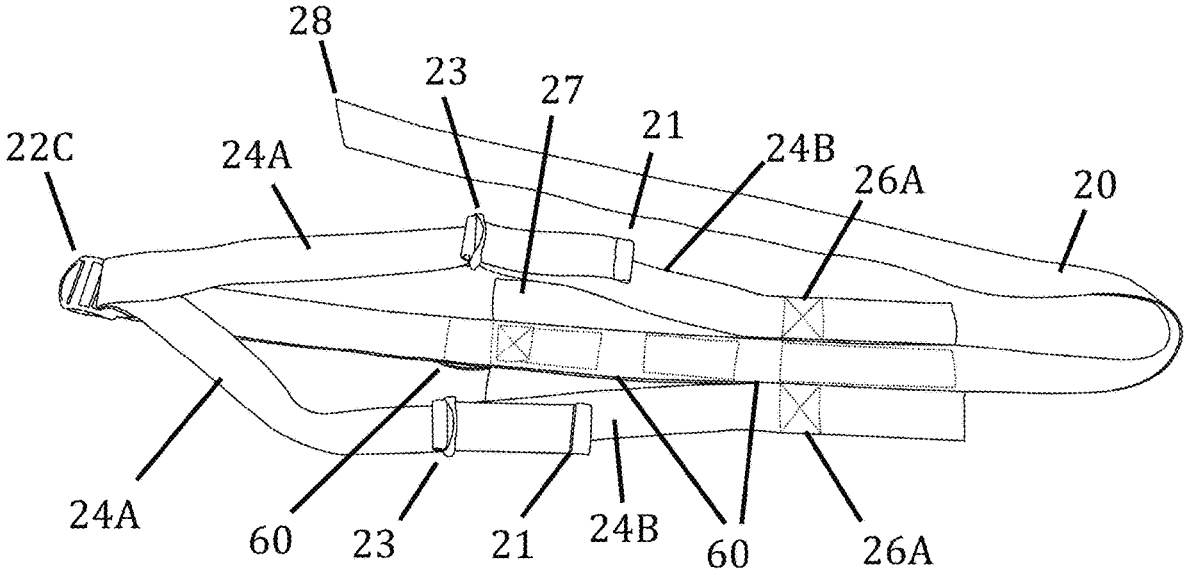
FIG. 26 shows a bottom view of a wearable sports equipment carrier with two primary loops, an object cradle 27 and two adjacent junction points.

Another embodiment(s) of the wearable sports equipment carrier 10 with two primary loop elements 24 and incorporating an object cradle 27 is shown in FIG. 25. As described earlier the carrier 10 is preferably fabricated from a polyester, polypropylene or nylon webbing. While dimensions can vary, a reasonable size is for the strap element is generally about 5.08 cm (2") wide and 2.46 m (8') long. A good choice for the object cradle 27 is between 12.70 cm (5") to 15.24 cm (6") wide and 53.34 cm (21") long and made out of the same webbing material as the strap itself. Generally, about ⅔ the length of the webbing material is used to form the primary loop element 24 leaving approximately ⅓ its length leftover to form a strap element 20. In this embodiment there will be two primary loop elements 24 but only one strap element so one piece of webbing will be 2.46 m (8') long while the other will be about ⅔ the length or 1.64 m (5.3') long. The shorter length webbing is laid on top of the longer length webbing with their ends aligned to each other. This stacked webbing is attached to the object cradle 27 along the lengthwise centerline of the object cradle 27 staring with the shorter webbing end aligned with the short side edge of the object cradle 27 leaving the last ⅓ of the longer webbing to form the strap element 20. Both of the aligned ends of the stacked webbing are inserted through a free moving ladder lock 22C and fold back on themselves, then separated apart from each other by the width of their webbing material (5.08 cm (2")) and attached to the object cradle 27 at two different junction points 26A on either side of combined webbing about 15.24 cm (6"), from the end of the object cradle 27, the side where the strap element 20 begins, to form two primary loop elements 24 (see FIG. 25). The primary loop element 24 length can be chosen for the size of the person using the carrier and the object to be carried. This embodiment also incorporates the previously described adjustable primary loop element's 24 by dividing each primary loop element into two sections: an upper primary loop element 24A and a lower primary loop element 24B and then coupling the two sections back together via a connection element such as a ladder lock adjuster 23 (see FIGS. 25 and 26). This embodiment is shown using a ladder lock 22C but it could easily be utilized on any other embodiment(s) with a different connect 22, 22A, 22B, 22D, etc. All other functionality of those embodiment(s) remains the same and will not be described here.

Figure 27:
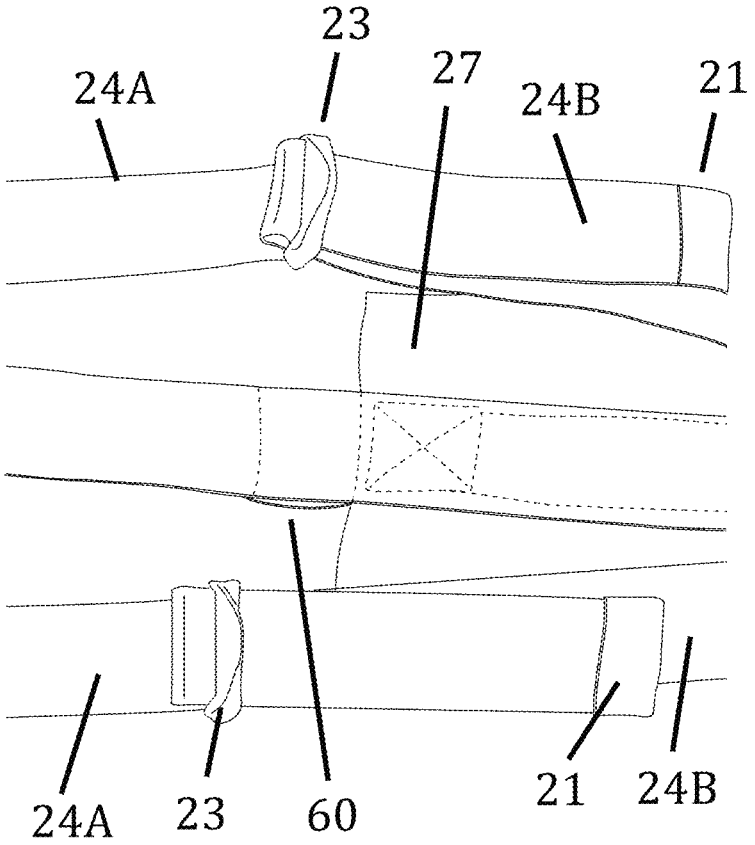
FIG. 27 shows a close up for seeing the slot opening 60 of a bottom view of a wearable sports equipment carrier with two primary loops, and an object cradle 27

Another embodiment (s) of a wearable sports equipment carrier 10 has a slot opening 60 in the primary loop elements 24 (see FIG. 27) at a height near the top and/or middle and/or bottom of the object to be carried to accommodate an object retainer strap(s) 62. The object retainer strap 62 is a strap that wraps around the object to be carried preventing the object from sliding out the side of the sports equipment carrier 10. The object retainer strap 62 is entered orthogonal through the slot opening 60 and wrap completely around the object to be carried connecting to the strap element 20 at halfway point of the perimeter or midway point circumference (for a cylinder) of the object being carried so that there is equal distance in both directions when measuring the half the perimeter or circumference (for a cylinder) distance between the primary loop element 24 to the strap element 20 preventing the object being carried from slipping out the side of the wearable sports equipment carrier (see FIGS. 29 and 30). The slot opening 60 is made by attaching the two primary loop elements 24 together perpendicular to their lengthwise edge at a spacing larger than the object retainer strap 62 webbing width (approximately 61.25 cm (2.5")) to allow the object retainer strap 62 to slide in between the two primary loop element 24 surfaces, the first face of primary loop element 24 and the second face of the other primary loop element 24 (see FIG. 27). The slot opening 60 can be located at the top of the secondary primary loop just past the end of the object cradle 27 to wrap the top of an object to be carried (as shown in FIG. 27), midway through the object cradle 27 to wrap the middle of an object to be carried, or near the bottom object cradle 27 to wrap the bottom of an object to be carried.

Figure 28:
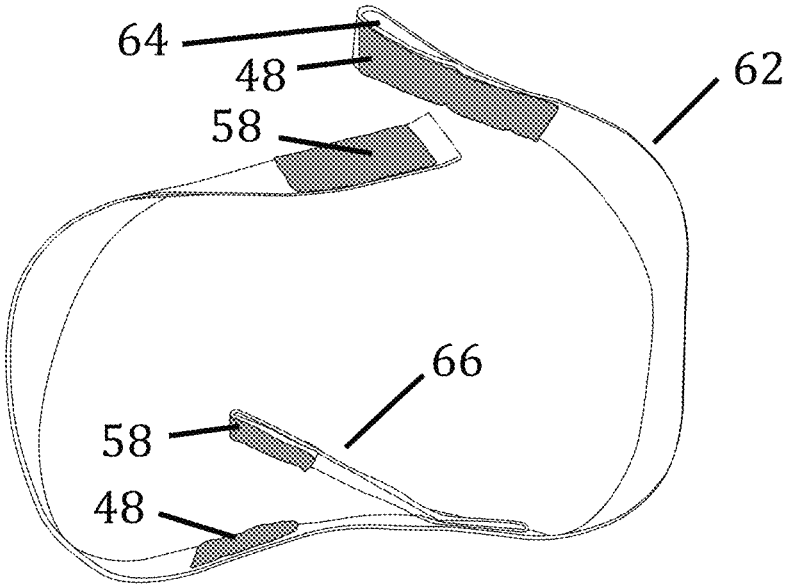
FIG. 28 shows an object retainer strap 62

The object retainer strap 62 can be made from the same a webbing material as the sports equipment carrier 10 with its assembled length is larger than the perimeter or circumference (for a cylinder) of the object to be retained. One end is folded back on and attached to itself to form the object retainer loop 64 which is wide enough to accept the width of the strap element 20 approximately 61.25 cm (2.5")). On the first face is some connecting method, such a loop fastener patch 58, which will fasten to the other end of the object retainer strap 62 with a supporting connecting method, such as hook fastener patch 48. A center point manacle 66, which is made from a webbing material of the same width as the object retainer strap 26 and a length sufficient to extend go over the strap element 20 width and have two attachment points to the object retainer strap element. A good size is about 159.25 cm (6.5") to allow 61.25 (2.5") for the strap element 20 width and then two 49 cm (2") connection points. One end, a primary connection point, is securely attached to the object retainer strap 62 so that the center point manacle 66 lengthwise center point aligns with the object retainer strap 62 lengthwise center point. The other end, a second connection point, utilizes some connecting method, such as such a loop fastener patch 58 and such a hook fastener patch 48, to fasten to the object retainer strap 62 to create an opening width wide enough to encompass the strap element 20, approximately 61.25 cm (2.5"), (see FIG. 28).

Figure 29:
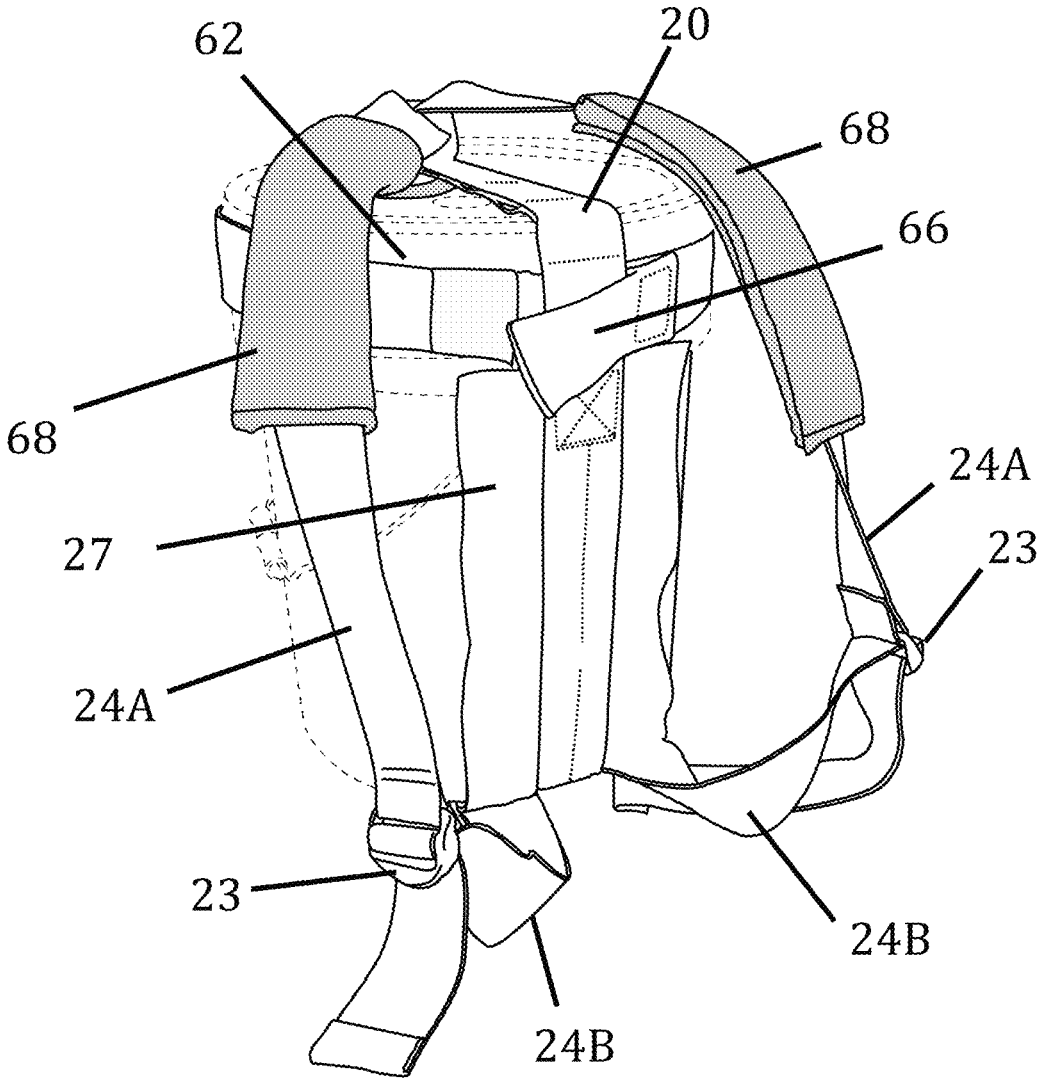
FIG. 29 shows a perspective front side view of wearable sports equipment carrier wrapping an object and has an object retainer 62 attached
Figure 30:
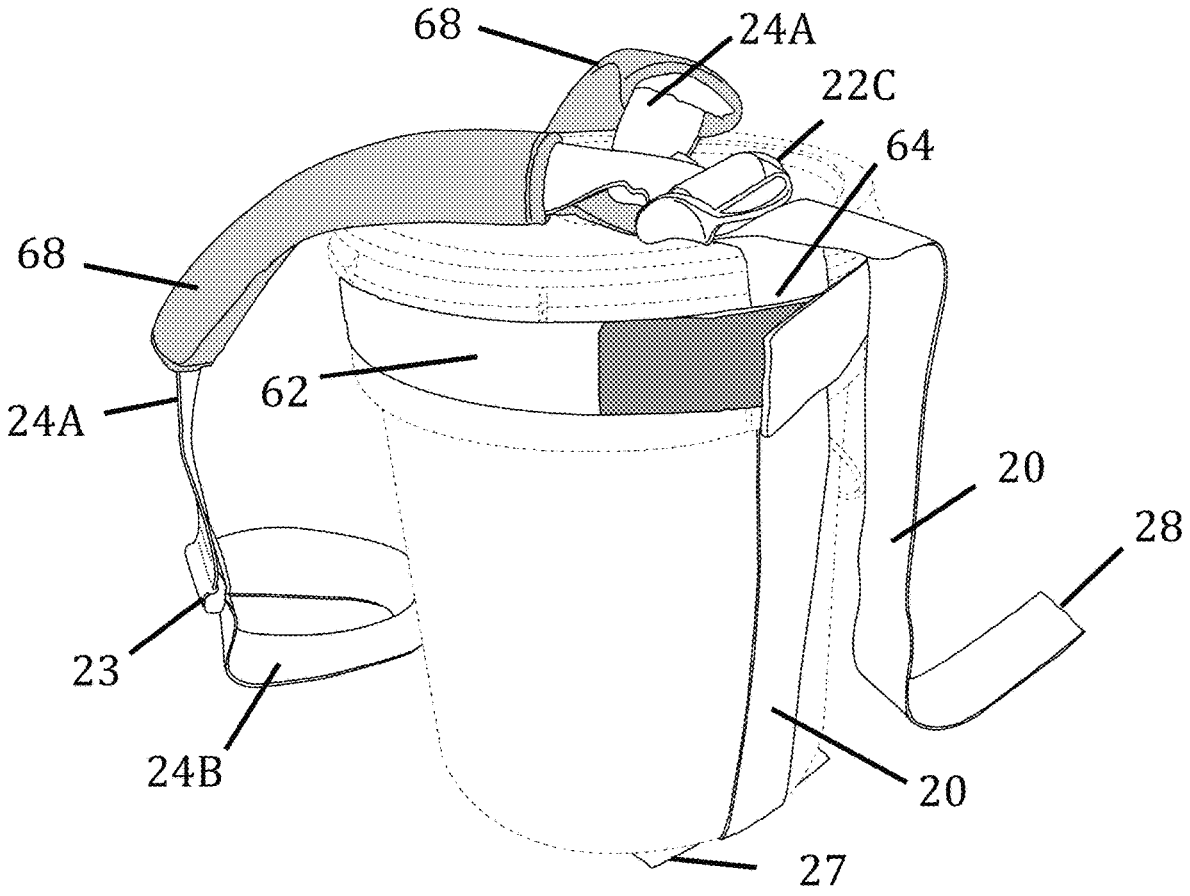
FIG. 30 shows a perspective back side view of wearable sports equipment carrier wrapping an object and has an object retainer 62 attached

To utilize the object retainer strap 62 the user slides it through the slot opening 60 of the sports equipment carrier 10 and then object retainer loop 64 attaches to the object retainer strap 62 to hold its position at the midway point of the object retainer strap 62. The strap element 20 of the sports equipment carrier 10 is inserted through the object retainer loop 64 so it wraps halfway around the sports equipment carrier 10 at either the top level, middle level or bottom level of the object to be carried. It is now ready to interface with the object to be carried. The user tilts the object to be carried so that the object cradle 27 can slide under the virtual vertical center point the object to be carried allowing the object retainer strap 62 to eventually to be centered and the ability to apply equal and opposite forces on both sides of the object to be carried. Once the object is placed on the sports equipment carrier 10 and tightened then the ends of the object retainer strap 62 are connected together to completely wrap around the object to be carried and retains the object in place during transport when sideways movements occur (FIGS. 29 and 30). For addition movement stability an additional object retainer strap(s) 62 can be used around the center height and bottom of the object to be carried.

Another embodiment(s) of wearable sports equipment carrier can incorporate a personal flotation device 36 which is out of the way when the carrier is used to carry a surfboard but operational as a personal flotation device when the carrier is worn as a belt. For this embodiment, the personal flotation device (PFD) 36 is attached to the strap element 20 (see FIG. 7) so that when it is used as a carrier it resides out of the way along the width of the surfboard (see FIG. 8). When the wearable sports equipment carrier is used as a belt (see FIG. 10) the PFD 36 provides typical belt-type personal flotation device functionality.

Figure 31:
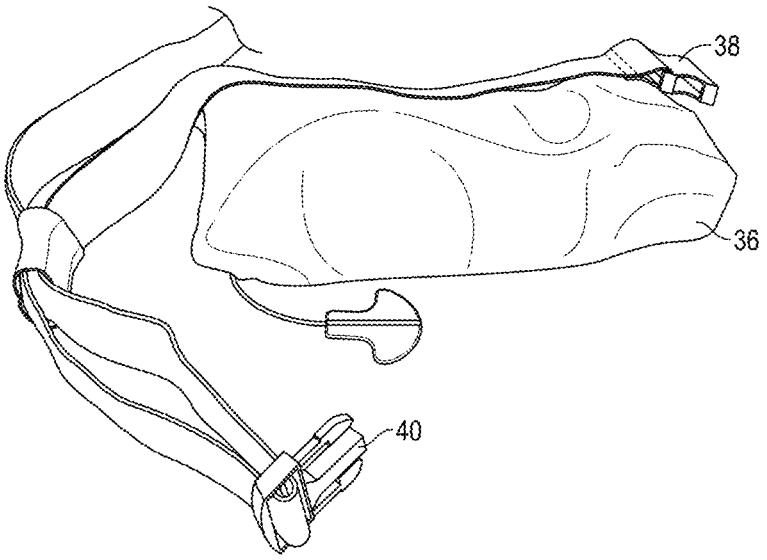
FIG. 31 shows an example of a personal flotation device which may be used with the wearable sports equipment carrier.
Figure 32:
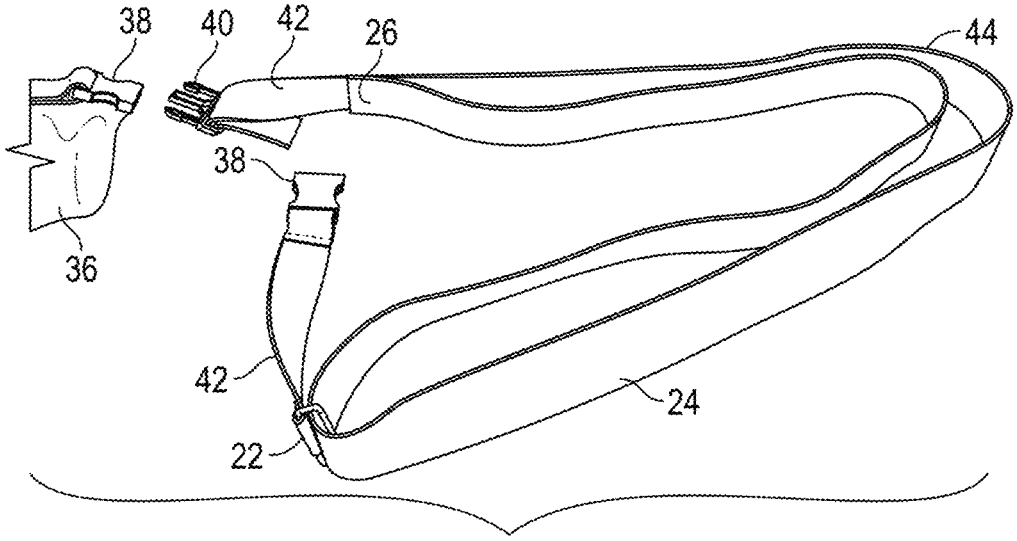
FIG. 32 shows an example of a primary loop element assembly which mates to connectors of a personal flotation device.
Figure 33:
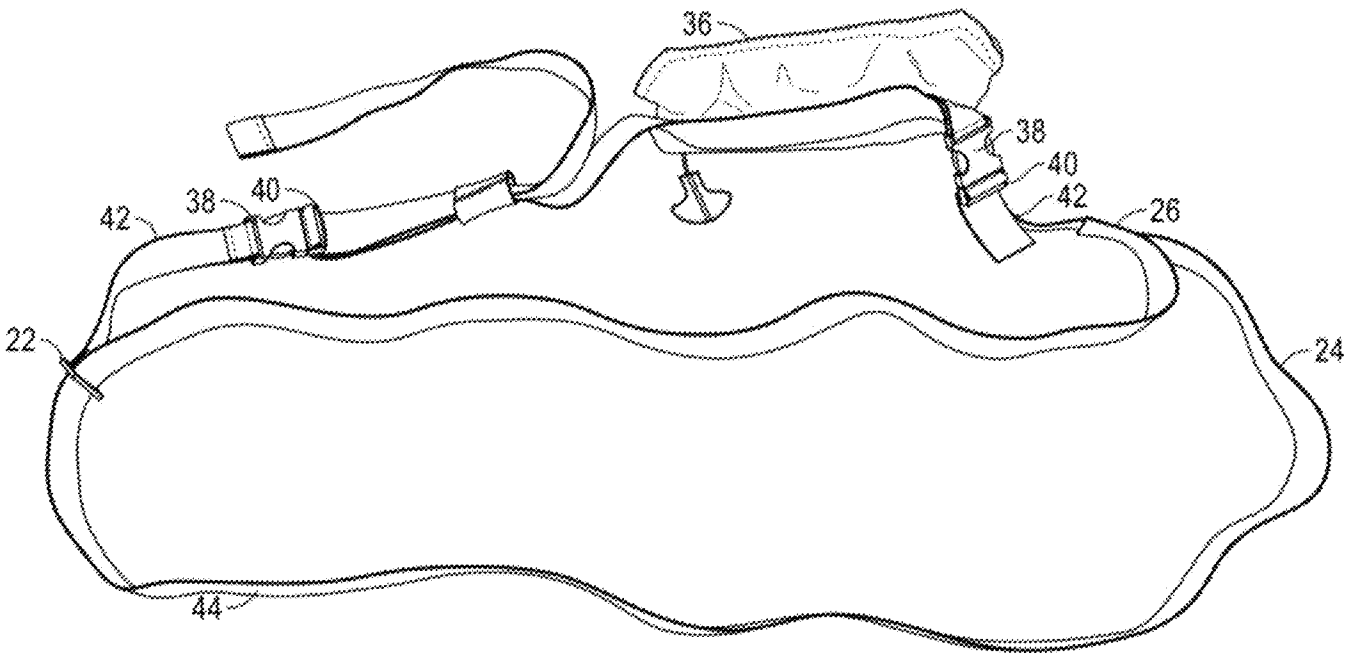
FIG. 33 shows an example of a wearable sports equipment carrier including a personal flotation device connected to a primary loop element assembly 44

FIGS. 31-33 show a design configuration of the wearable sports equipment carrier where the hook-and-loop fastener attachment approach is replaced by a two-piece snap buckle of the type commonly used in sports equipment, backpacks, etc. These male-and-female buckle embodiment(s) of the wearable sports equipment carrier can use an existing personal flotation device (PFD) 36 with its own connectors 38 and 40 (see FIG. 31) in lieu of the strap element 20 and connect a primary loop element assembly 44 (see FIG. 32) to the PFD 36 using the existing PFD's connectors 38 and 40 so that the combination of the PFD 36 and the primary loop element assembly 44 becomes a wearable sports equipment carrier with a personal flotation device. The primary loop assembly 44 consists of the primary loop element 24 having a free moving loop buckle 22 retained thereon, a female connector 38 attached to the loop buckle 22 by a strap buckle extender 42 between the female connector 38 and the loop buckle 22, and a male connector 40 attached to the end junction point 26 by a strap buckle extender 42 between the male connector 40 and the end junction point 26 (see FIG. 32).

The purpose of the strap buckle extender 42 is to ensure that, when the female 38 and male 40 connectors are mated, their hard surface lays on a flat plane of the surfboard (e.g., the bottom) and not on the rounded edge of the surfboard which could damage the surfboard edge. Generally, the distance of the strap buckle extender 42 between the two attachment points is the maximum thickness of the surfboard or SUP for which the carrier is designed, or approximately about 10.16 cm (4") inches. The size of the secondary adjustable loop is now changed by increasing or decreasing the loop length with the adjustment capability of the male connector 40 similar to the method described above for the tongue 28 through the loop buckle 22 and attachment-surface 30 connection.

FIG. 33 shows the sports equipment carrier assembled with the PFD 36, where the primary loop element 24 (worn over user's shoulder) is at the bottom, and the secondary adjustable loop (which holds the surfboard) with PFD 36 is at the top. It is noted that the configuration of the sports equipment carrier shown in FIG. 33 can be used with (FIG. 33) or without (FIG. 32) the separate PFD 36, both in the surfboard-carrying mode and in the wearable belt mode. Furthermore, the sports equipment carrier of FIG. 33 can be simplified by making the female buckle 38 (at left) slidable and positioning it in place of the loop buckle 22A; then the male buckle 40 (at right) can be attached to the female buckle 38 to form the secondary adjustable loop.

To summarize, the embodiments of the wearable sports equipment carrier include: a hook-and-loop fastener based design (FIGS. 3-17), with or without the PFD 36 attached (such as be sewing) directly to the strap element 20 (FIG. 10); a D ring design (FIG. 18), with or without the PFD 36 attached (such as be sewing) directly to the strap element 20; a ladder lock based design (FIGS. 19, 21-24), with or without the PFD 36 attached (such as be sewing) directly to the strap element 20; and a male-and-female buckle based design (FIGS. 20, 32-33), with or without the PFD 36 attachable in series with the primary loop element assembly 44. The buckle-based design could also include the PFD 36 attached directly to the strap element 20. All of these design embodiments are operable in a surfboard carrying mode and a wearable belt mode, providing the user with an optimal combination of utility, convenience and safety enhancement. In any of these embodiments, the PFD 36 is preferably a compact, inflatable flotation device which manually inflates when the wearer pulls a "jerk to inflate" handle. This type of PFD—sometimes referred to as a belt-type—provides unrestricted motion and movement for the user due to the minimal PFD bulk. Inflation is achieved via a compressed gas cartridge (such as $CO_2$) which is discharged when the inflation handle is pulled.

Another embodiment (s) of a wearable sports equipment carrier 10 with either one or two primary loop elements 24 has a shoulder cushion or pad 68 over one or, if two, both primary loop element (s) 24 to provide comfort to the user. This could be a simple seat belt shoulder cushion sliding over the two primary loop elements 24 or permanently attached to one or both primary loop elements 24 (see FIG. 29 and FIG. 30).

Figure 34:
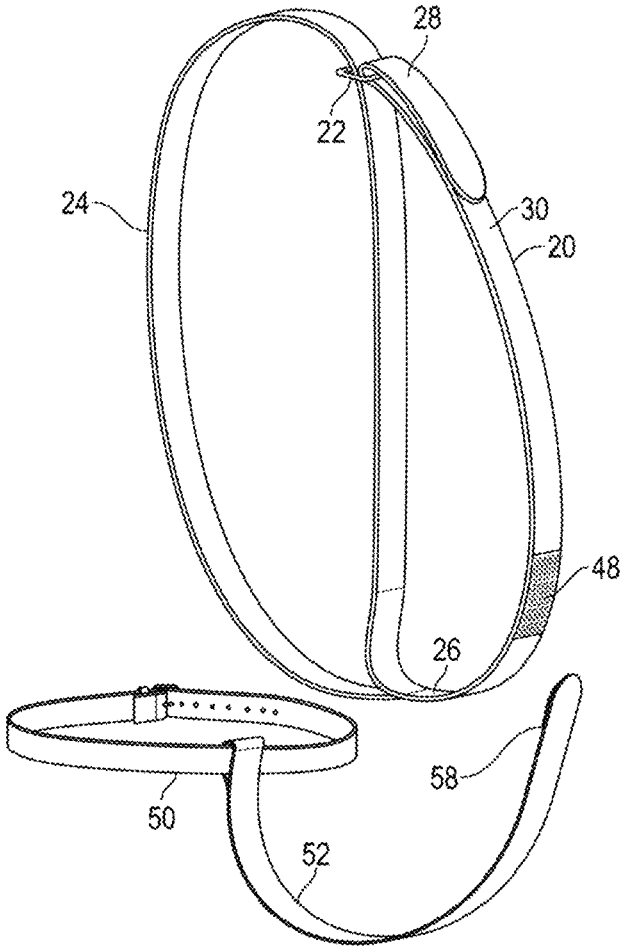
FIG. 34 shows an embodiment of a wearable sports equipment carrier system including a separate belt 50 and weight transfer strap 52.

FIG. 34 is an illustration of an embodiment of a wearable sports equipment carrier system including a separate weight distribution belt 50 and a weight transfer strap 52. The belt 50 and strap 52 may be used in conjunction with the carrier 10 for situations where the carrier 10 is being used to carry a heavy load. For example, if the carrier 10 is being used to carry a heavy surfboard or even something like a bag of concrete, the weight of the heavy load may cause user discomfort where the primary loop element 24 bears on the user's shoulder. Using the weight distribution belt 50 and the weight transfer strap 52, part of the weight of the load can be borne by the user's waist and hips, thus reducing the pressure on the user's shoulder.

The belt 50 can be fastened around the user's waist in any suitable fashion, such as with a snap buckle, a hook-and-loop fastener arrangement, or any other type of buckle. One end of the weight transfer strap 52 may be permanently or removably attached to the belt 50 so as to securely transfer a load. The other end of the weight transfer strap 52 may conveniently be attached to the strap element 20 using a hook fastener patch 48 on the strap element 20 and a loop fastener patch 58 on the weight transfer strap 52. The attachment of the weight transfer strap 52 to the strap element 20 can be adjusted by the user so that the weight transfer strap 52 pulls downward on the belt 50, thereby distributing the load between the belt 50 and the carrier 10.

Figure 20:
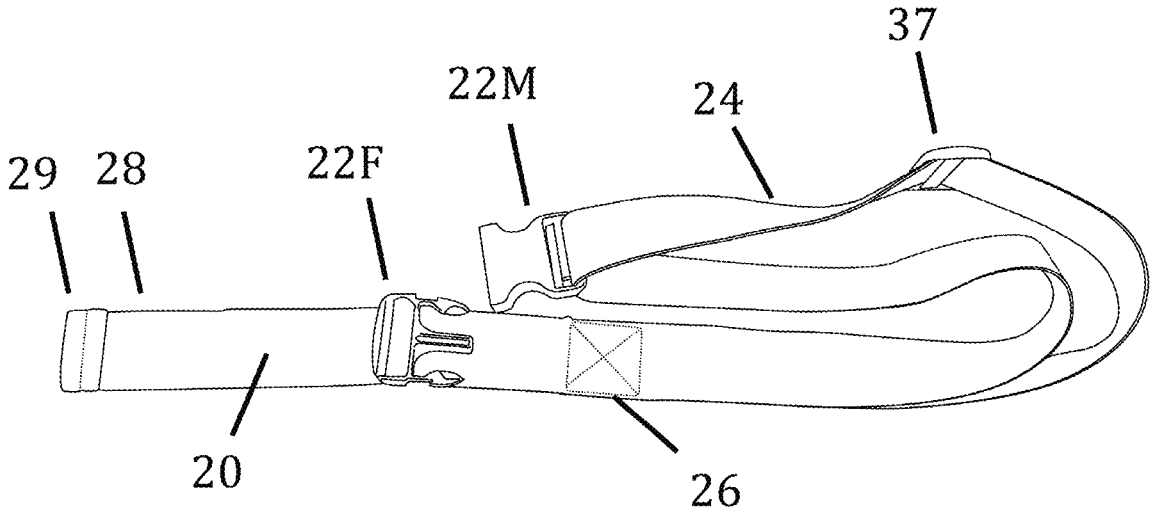
FIG. 20 shows a wearable sports equipment carrier with the buckle being quick release buckle.

The configurations described above are not the only embodiments of the disclosed invention. Alternatively:

- Different materials, size and interconnections can be used for all components
- The webbing material could be eliminated if the attachment-surface 30 is two sided
- In lieu of hook and loop, D rings, ladder lock, side release buckles, fasteners, some other fastening system like snaps, buttons, magnets, etc. can be used for securing the surfboard or other object as seen in FIG. 20
- In lieu of a buckle or two opening buckle with hook and loop some other length adjusting system like a D ring, ladder lock, side release buckle, etc. can be used
- In lieu of one fold, two or more folds could be made to further decrease the size of the carrier (see FIG. 11) and various connections and buckles can hold the folded material in place
- In lieu of a continuous assembly the primary loop and strap element can be made a separate assemblies and attached together similar to the assembly shown in FIG. 31.
- The wearable sports equipment carrier can also be have other items attach to it, such as a water bottle, camera, phone, personal flotation device, etc., by integrating them as part of the wearable sports equipment carrier.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

I claim:

1. An equipment carrying device comprising:

a strap element comprising opposing first and second faces, said strap element having a first end, a second end and an attachment point intermediate the first and second ends;

and a first buckle slidably disposed along the strap element between the first end and the attachment point;

where the first face at the first end is permanently and immovably attached to the first face at the attachment point to define a first loop sized to receive a user's shoulder, with the buckle being positionable along the first loop, and where the buckle is operable with the second end of the strap element to create a self-tightening adjustable second loop suitable for securing around an object to be carried, and where the adjustable second loop is adjustable to a size suitable for wearing the device as a belt around a waist of the user a second strap element comprising opposing first and second faces, said second strap element having a first end, a second end; a loop attachment portion providing a first strap element attachment point intermediate the first end and the second end of said first strap element, an attachment surface for said first face of said first strap element, a second strap element attachment point intermediate said first end and said second end of said second strap element and an attachment surface for said first face of said second strap element; and sharing said buckle such that it is also slidably disposed along the second strap element between the first end and the second strap element attachment point; where the first face at the first end of the second strap element is permanently and immovably attached to both the first face of the second strap element at the second strap attachment point and with said first strap element attachment point to define a second first loop sized to receive a user's same or other shoulder, with the buckle being positionable along the second strap element first loop.

2. The equipment carrying device according to claim 1 further comprising hook-and-loop fastening patches, on the second face of the strap element at a location halfway around the first loop from the junction point, and on the first face of the strap element at a location between the junction point and the second end, where the hook-and-loop fastening patches are suitable for doubling over and securing the first loop, thereby shortening a distance between the buckle and the second end to achieve improved fit when the device is worn as a belt around the waist of the user.

3. The equipment carrying according to any one of claim 1, wherein said first loop is an adjustable first loop(s) having loop adjustment means for altering the loop size to facilitate the user's comfort while carrying an object.

4. The equipment carrying device according to any one of claim 1, further comprising one or more fastening patches on the second face of the strap element proximal the second end, where the second end of the strap element is insertable through the first buckle and attachable at a user-selected location on the strap element via the fastening patches, thereby creating the adjustable second loop suitable, and where the fastening patches are mating pieces of hook-and-loop type fastener material.

5. The equipment carrying device according to claim 1 wherein the first buckle is two D-rings.

6. The equipment carrying device according to any one of claim 1, wherein the first buckle is a ladder lock.

7. The equipment carrying device according to any one of claim 1, further comprising a second buckle adjustably positioned along the strap element between the junction point and the second end, where the second buckle is attachable to the first buckle, thereby creating the adjustable second loop.

8. The equipment carrying device according to claim 7 wherein the first and second buckle are female and male snap-connect buckles, respectively.

9. The equipment carrying device according to claim 1, wherein a Personal Flotation Device (PFD) is attached to the strap element of the device.

10. The equipment carrying device according to claim 8 wherein the PFD includes a buckle at each end, and the PFD is connectable in series with the strap element by connecting the buckles on the ends of the PFD with the male and female buckle components of the device, respectively.

11. The equipment carrying device according to claim 9 wherein the PFD is a compact belt-type PFD which inflates when a handle is pulled by the user.

12. The equipment carrying device according to claim 10 wherein the PFD is a compact belt-type PFD which inflates when a handle is pulled by the user.

13. The equipment carrying device according to claim 10 further comprising a strap element extender attached to the female buckle component and extending the female buckle component a distance from the first loop sufficient to position the PFD at a suitable location on the object to be carried.

14. The equipment carrying device according to claim 1, further comprising an object retainer strap where the object retainer strap is operable with the carrier and adjustably attachable to itself for securing around an object to be carried preventing object slipping out of the self-tightening adjustable second loop when the object is subjected to sideways forces.

* * * * *